US007600861B2

(12) United States Patent
Hibi et al.

(10) Patent No.: US 7,600,861 B2
(45) Date of Patent: Oct. 13, 2009

(54) INKJET HEAD

(75) Inventors: Manabu Hibi, Nagoya (JP); Kenichi Satake, Osaka (JP); Shin Ishikura, Kirishima (JP)

(73) Assignees: Brother Kogyo Kabushiki Kaisha, Nagoya-shi, Aichi-ken (JP); Kyocera Corporation, Kyoto-shi, Kyoto-fu (JP)

( * ) Notice: Subject to any disclaimer, the term of this patent is extended or adjusted under 35 U.S.C. 154(b) by 390 days.

(21) Appl. No.: 11/683,996

(22) Filed: Mar. 8, 2007

(65) Prior Publication Data

US 2007/0211090 A1 Sep. 13, 2007

(30) Foreign Application Priority Data

Mar. 10, 2006 (JP) ..... 2006-065215

(51) Int. Cl.
*B41J 2/045* (2006.01)
*B41J 29/38* (2006.01)

(52) U.S. Cl. ..... 347/70; 347/10

(58) Field of Classification Search ..... 347/9–11, 347/68, 70–72
See application file for complete search history.

(56) References Cited

U.S. PATENT DOCUMENTS 5,381,162 A 1/1995 Roy et al.
6,141,113 A * 10/2000 Takahashi ..... 358/1.8
6,808,254 B2 10/2004 Sakaida et al.
7,086,711 B2 * 8/2006 Iwao et al. ..... 347/10
2008/0084457 A1 * 4/2008 Hibi et al. ..... 347/70

FOREIGN PATENT DOCUMENTS

EP 0648606 A2 10/1993
EP 0775579 A2 5/1997
JP 2003-305852 A 10/2003

OTHER PUBLICATIONS

European Patent Office, European Search Report dated Jul. 17, 2008, for related European Patent Application No. 07250990.

* cited by examiner

*Primary Examiner*—An H Do
(74) *Attorney, Agent, or Firm*—Baker Botts L.L.P.

(57) ABSTRACT

An actuator can selectively take a first state wherein a volume of a pressure chamber is V1 and a second state wherein the volume of the pressure chamber is V2 larger than V1. The actuator changes from the first state to the second state and then returns to the first state to eject ink from an ejection port. A proper oscillation period Ts of an oscillation generated by integral deformation of the actuator and the pressure chamber when ink is ejected from the ejection port, and a proper oscillation period Td of ink filling up a first partial passage leading from an outlet of the pressure chamber to the ejection port in an individual ink passage, satisfy a condition that Ts/Td is not less than 0.36 and not more than 0.90; or not less than 1.1 and not more than 1.7.

9 Claims, 12 Drawing Sheets

INKJET HEAD

CROSS-REFERENCE TO RELATED APPLICATION

This application claims priority to and the benefit of Japanese Patent Application No. 2006-065215 filed on Mar. 10, 2006, the disclosure of which is incorporated herein by reference.

BACKGROUND OF THE INVENTION

1. Field of the Invention

The present invention relates to an inkjet head using a so-called fill-before-fire method.

2. Description of Related Art

An inkjet head that ejects ink by an inkjet system includes therein nozzles from each of which ink is ejected; a common ink chamber that supplies ink to be ejected from each nozzle; and individual ink passages leading from the common ink chamber to the respective nozzles. When the inkjet head ejects ink, a pressure is applied to ink in a pressure chamber formed at a portion of each individual ink passage, and ink supplied from the common ink chamber is thereby ejected from each nozzle. At this time, a pressure wave is generated by applying the pressure to ink in the pressure chamber, and as a result, the proper oscillation of the pressure chamber is generated in the individual ink passage. Japanese Patent Unexamined Publication No. 2003-305852, particularly in FIG. 7 of the publication, discloses an inkjet head that efficiently ejects ink by using peaks of the proper oscillation. The inkjet head of the publication adopts a so-called fill-before-fire method in which the volume of each pressure chamber is once increased and then the pressure chamber is restored to its original volume after a predetermined time elapses, to apply a pressure to ink in the pressure chamber.

However, when an inkjet head using the fill-before-fire method as in the above publication ejects ink, some shapes of individual ink passages may cause a case wherein a tip portion of an ink droplet is split off from the main body of the droplet to form a high-speed small ink droplet. That is, some shapes of individual ink passages may cause a case wherein a split-off ink droplet impacts a printing paper at a different timing from that of the original ink droplet. This brings about a problem of degradation in the reproducibility of an image to be formed on a printing paper by the inkjet head.

SUMMARY OF THE INVENTION

An object of the present invention is to provide an inkjet head in which a tip portion of each ink droplet is hard to be split off from the main body of the droplet and thus an image can be printed with good reproducibility According to the present invention, an inkjet head comprises a passage unit comprising a common ink chamber, and an individual ink passage leading from an outlet of the common ink chamber through a pressure chamber to an ink ejection port; and an actuator that can selectively take a first state wherein a volume of the pressure chamber is V1 and a second state wherein the volume of the pressure chamber is V2 larger than V1. The actuator changes from the first state to the second state and then returns to the first state to eject ink from the ejection port. A proper oscillation period Ts of an oscillation generated by integral deformation of the actuator and the pressure chamber when ink is ejected from the ejection port, and a proper oscillation period Td of ink filling up a first partial passage in the individual ink passage leading from an outlet of the pressure chamber to the ejection port, satisfy a condition that Ts/Td is not less than 0.36 and not more than 0.90; or not less then 1.1 and not more than 1.7.

According to the invention, as will be understood from the analysis as will be described later, Ts/Td has been controlled to fall within a range 71 or a range 72 in FIG. 11, except the range containing points 81*a*, each of which represents a high-speed ink droplet generated by splitting off a tip portion of an ink droplet from the main body of the ink droplet. This realizes an inkjet head in which a tip portion of each ink droplet is hard to be split off and therefore the reproducibility of an image is high.

BRIEF DESCRIPTION OF THE DRAWINGS

Other and further objects, features and advantages of the invention will appear more fully from the following description taken in connection with the accompanying drawings in which.

DESCRIPTION OF THE PREFERRED EMBODIMENTS

Hereinafter, a preferred embodiment of the present invention and results of analysis by the inventors of the present invention will be described with reference to the accompanying drawings.

Figure 1:
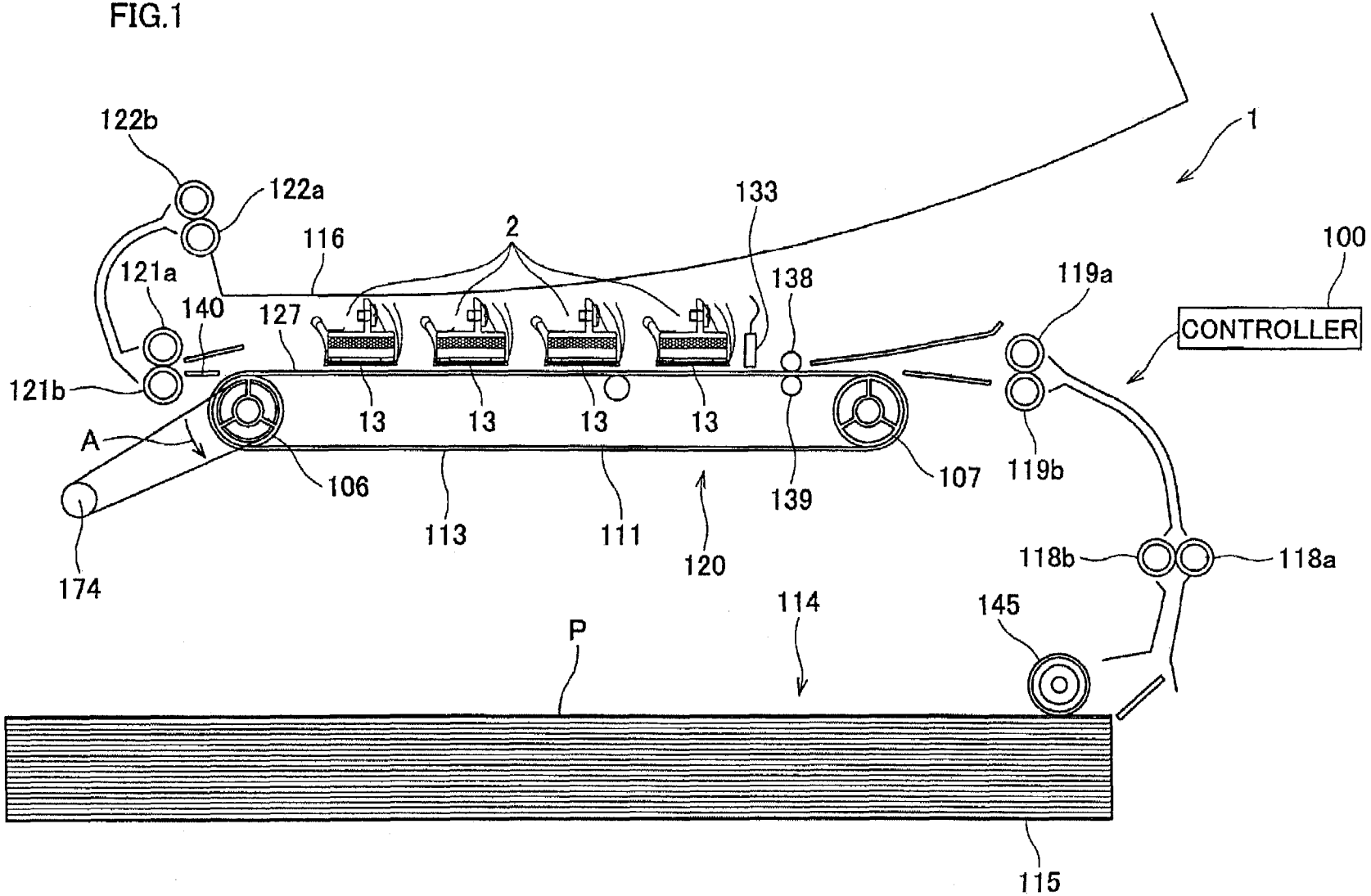
FIG. 1 shows a general construction of a printer as an inkjet recording apparatus according to an embodiment of the present invention.

FIG. 1 shows a general construction of a color inkjet printer according to an embodiment of the present invention. The printer 1 includes therein four inkjet heads 2. The inkjet heads 2 are fixed to the printer 1 in a state of being arranged in the direction of conveyance of printing papers P. Each inkjet head 2 has a slender profile extending perpendicularly to FIG. 1.

The printer 1 includes therein a paper feed unit 114, a conveyance unit 120, and a paper receiving unit 116 provided in this order along the conveyance path for printing papers P. The printer 1 further includes therein a controller 100 that controls the operations of components and units of the printer 1 including the inkjet heads 2 and the paper feed unit 114.

The paper feed unit 114 includes a paper case 115 and a paper feed roller 145. The paper case 115 can contain therein a stack of printing papers P. The paper feed roller 145 can send out the uppermost one of the printing papers P contained in the paper case 115, one by one.

Between the paper feed unit 114 and the conveyance unit 120, two pairs of feed rollers 118*a* and 118*b*; and 119*a* and 119*b* are disposed along the conveyance path for printing papers P. Each printing paper P sent out of the paper feed unit 114 is guided by the feed rollers to be sent to the conveyance unit 120.

The conveyance unit 120 includes an endless conveyor belt 111 and two belt rollers 106 and 107. The conveyor belt 111 is wrapped on the belt rollers 106 and 107. The length of the conveyor belt 111 is adjusted so that a predetermined tension can be obtained when the conveyor belt 111 is stretched between the belt rollers. Thus, the conveyor belt 111 is stretched between the belt rollers without slacking, along two planes parallel to each other, each including a common tangent of the belt rollers. Of these two planes, the plane nearer to the inkjet heads 2 includes a conveyance surface 127 of the conveyor belt 111 on which printing papers P are conveyed.

As shown in FIG. 1, one belt roller 106 is connected to a conveyance motor 174. The conveyance motor 174 can rotate the belt roller 106 in the direction of an arrow A. The other belt roller 107 can follow the conveyor belt 111 to rotate. Thus, by driving the conveyance motor 174 to rotate the belt roller 106, the conveyor belt 111 is moved in the direction of the arrow A.

Near the belt roller 107, a nip roller 138 and a nip receiving roller 139 are disposed so as to nip the conveyor belt 111. The nip roller 138 is being biased downward by a not-shown spring. The nip receiving roller 139 disposed below the nip roller 138 is receiving through the conveyor belt 111 the force of the nip roller 138 being biased downward. Both of the nip roller. 138 and the nip receiving roller 139 are freely rotatable and follow the conveyor belt 111 to rotate.

Each printing paper P sent from the paper feed unit 114 to the conveyance unit 120 is interposed between the nip roller 138 and the conveyor belt 111. Thereby, the printing paper P is pressed onto the conveyance surface 127 of the conveyor belt 111 to adhere to the conveyance surface 127. The printing paper P is then conveyed toward the inkjet heads 2 by the rotation of the conveyor belt 111. The outer circumferential surface 113 of the conveyor belt 111 may have been treated with adhesive silicone rubber. In this case, the printing paper P can surely adhere to the conveyance surface 127 of the conveyor belt 111.

Figure 3:
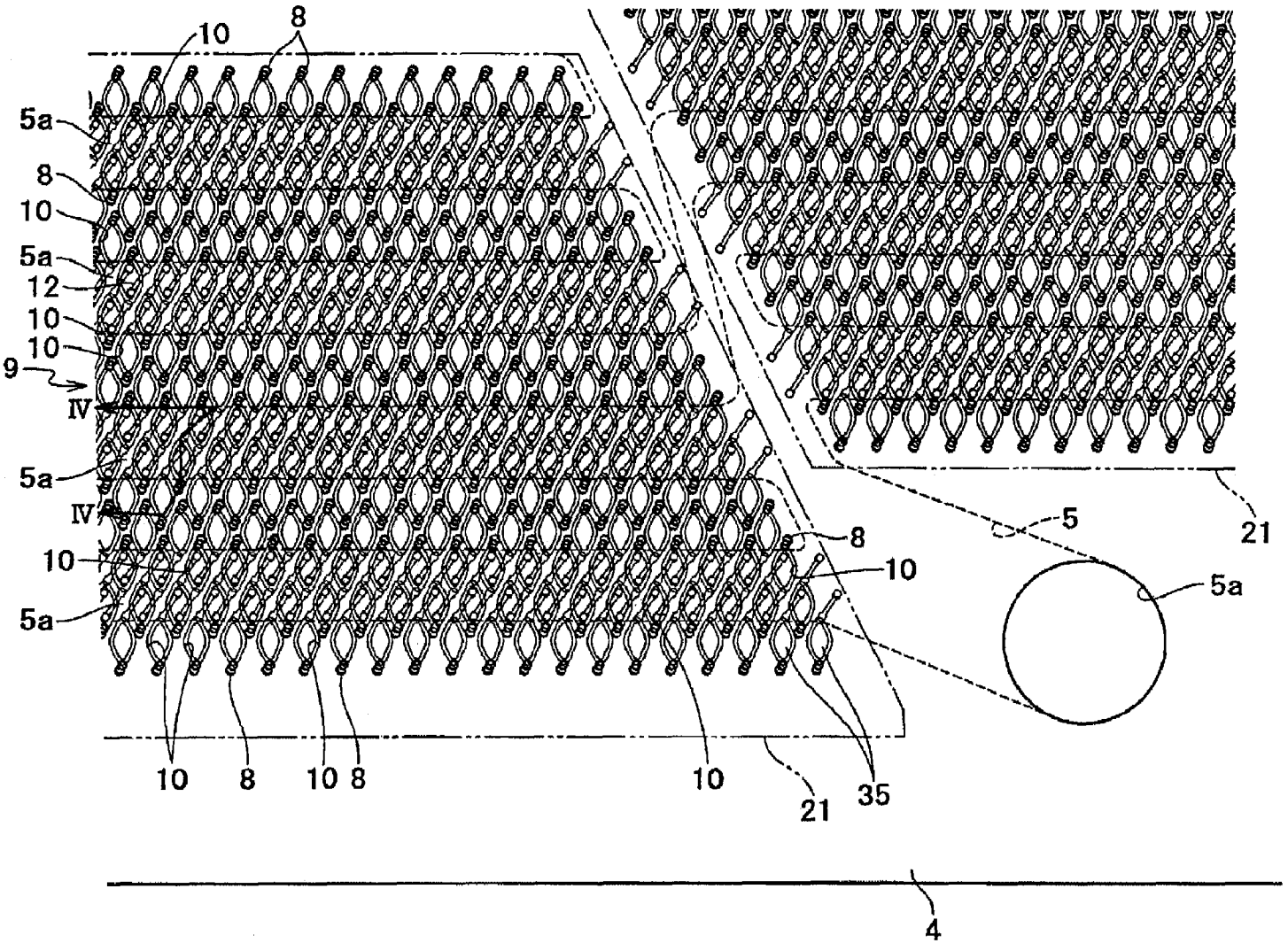
FIG. 3 is an enlarged view of a region enclosed with an alternate long and short dash line in FIG. 2.

Four inkjet heads 2 are arranged close to each other in the direction of conveyance by the conveyor belt 111. Each inkjet head 2 has at its lower end a head main body 13. A large number of nozzles 8 from each of which ink is ejected are formed on the lower face of each head main body 13, as shown in FIG. 3. Ink of the same color is ejected from the nozzles 8 formed on one inkjet head 2. Four inkjet heads 2 eject inks of colors of magenta (M), yellow (Y), cyan (C), and black (K), respectively. Each inkjet head 2 is disposed such that a narrow space is formed between its head main body 13 and the conveyance surface 127 of the conveyor belt 111.

Each printing paper P being conveyed by the conveyor belt 111 passes through the space between each inkjet head 2 and the conveyor belt 111. At this time, ink is ejected from the head main body 13 of the inkjet head 2 toward the upper surface of the printing paper P. Thus, a color image based on image data stored in a memory by an instruction of the controller 100 is formed on the upper surface of the printing paper P.

Between the conveyance unit 120 and the paper receiving unit 116, there are provided a peeling plate 140 and two pairs of feed rollers 121*a* and 121*b*; and 122*a* and 122*b*. Each printing paper P on which a color image has been printed is conveyed by the conveyor belt 111 toward the peeling plate 140. The printing paper P is then peeled off the conveyance surface 127 of the conveyor belt 111 by a right edge of the peeling plate 140. The printing paper P is then sent to the paper receiving unit 116 by the feed rollers 121*a* to 122*b*. Printed printing paper P are thus sent to the paper receiving unit 116 in order, and then stacked on the paper receiving unit 116.

A paper sensor 133 is provided between the nip roller 138 and the inkjet head 2 disposed at the most upstream position in the conveyance direction of printing papers P. The paper sensor 133 is constituted by a light emitting element and a light receiving element so as to be able to detect the leading edge of each printing paper P on the conveyance path. The result of the detection by the paper sensor 133 is sent to the controller 100. On the basis of the detection result sent from the paper sensor 133, the controller 100 can control each inkjet head 2, the conveyance motor 174, and so on, such that the conveyance operation for each printing paper P and the printing operation for an image are synchronized with each other.

Figure 2:
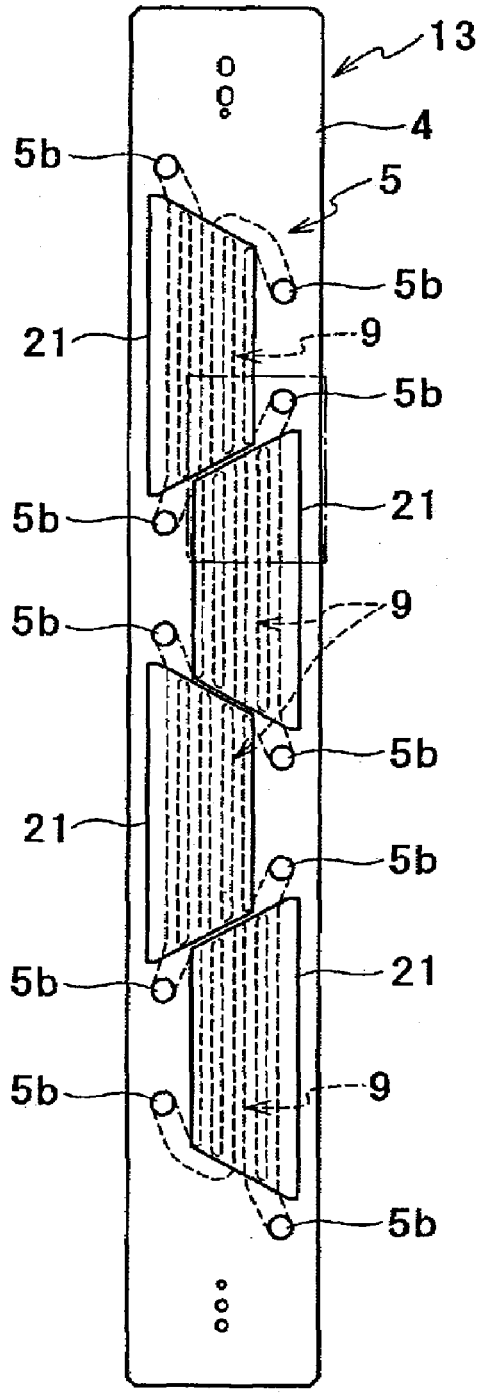
FIG. 2 is an upper view of a head main body shown in FIG. 1.

Next, the head main body 13 of each inkjet head 2 will be described. FIG. 2 is an upper view of a head main body 13 shown in FIG. 1.

The head main body 13 includes a passage unit 4 and four actuator units 21 each bonded onto the passage unit 4. Each actuator unit 21 is substantially trapezoidal. Each actuator unit 21 is disposed on the upper surface of the passage unit 4 such that a pair of parallel opposed sides of the trapezoid of the actuator unit 21 extend longitudinally of the passage unit 4. Two actuator units 21 are arranged on each of two straight lines extending parallel to each other longitudinally of the passage unit 4. That is, four actuator units 21 are arranged zigzag on the passage unit 4 as a whole. Each neighboring oblique sides of actuator units 21 on the passage unit 4 partially overlap each other laterally of the passage unit 4.

Manifold channels 5 each of which is part of an ink passage are formed in the passage unit 4. An opening 5*b* of each manifold channel 5 is formed on the upper face of the passage unit 4. Five openings 5*b* are arranged on each of two straight lines, as imaginary lines, extending parallel to each other longitudinally of the passage unit 4. That is, ten openings 5*b* in total are formed. The openings 5*b* are formed so as to avoid the regions where four actuator units 21 are disposed. Ink is supplied from a not-shown ink tank into each manifold channel 5 through its opening 5*b*.

FIG. 3 is an enlarged upper view of a region enclosed with an alternate long and short dash line in FIG. 2. In FIG. 3, for convenience of explanation, each actuator unit 21 is shown by an alternate long and two short dashes line. In addition, apertures 12, nozzles 8, and so on, are shown by solid lines though they should be shown by broken lines because they are formed in the passage unit 4 or on the lower face of the passage unit 4.

Each manifold channel 5 formed in the passage unit 4 branches into a number of sub manifold channels 5*a*. The manifold channel 5 runs along an oblique side of an actuator unit 21 to cross a longitudinal axis of the passage unit 4. In a region between two actuator units 21, one manifold channel 5 is shared by the neighboring actuator units 21. Sub manifold channels 5*a* are branched from both sides of the manifold channel 5. Sub manifold channels 5*a* are formed in the passage unit 4 so as to neighbor each other in a region opposed to each actuator unit 21.

The passage unit 4 includes therein pressure chamber groups 9 each constituted by a large number of pressure chambers 10 arranged in a matrix. Each pressure chamber 10 is formed into a hollow region having a substantially rhombic shape in plan view each corner of which is rounded. Each pressure chamber 10 is open at the upper face of the passage unit 4. Pressure chambers 10 are arranged substantially over a region of the upper face of the passage unit 4 opposed to each actuator unit 21. Thus, each pressure chamber group 9 constituted by the pressure chambers 10 occupies a region having substantially the same size and shape as one actuator unit 21. The opening of each pressure chamber 10 is covered by the corresponding actuator unit 21 bonded onto the upper surface of the passage unit 4. In this embodiment, as shown in FIG. 3, sixteen rows of pressure chambers 10 arranged longitudinally of the passage unit 4 at regular intervals are arranged parallel to each other laterally of the passage unit 4. The pressure chambers 10 are provided such that the number of pressure chambers 10 belonging to each row gradually decreases from the long side toward the short side of the profile of the corresponding piezoelectric actuator 50. The nozzles 8 are provided likewise. This realizes image formation with a resolution of 600 dpi as a whole.

An individual electrode 35, as will be described later, is formed on the upper face of each actuator unit 21 so as to be opposed to each pressure chamber 10. The individual electrode 35 has its shape somewhat smaller than and substantially similar to the shape of the pressure chamber 10. The individual electrode 35 is disposed within a region of the upper face of the actuator unit 21 opposed to the pressure chamber 10.

Either of the pressure chamber 10 and the individual electrode 35 is long vertically in FIG. 3. Either of the pressure chamber 10 and the individual electrode 35 is tapered both upward and downward from its vertical center. This realize dense arrangements of a large number of pressure chambers 10 and a large number of individual electrodes 35 in the respective planes.

A large number of nozzles 8 as ejection ports are formed on the passage unit 4. The nozzles 8 are disposed so as to avoid regions of the lower face of the passage unit 4 opposed to sub manifold channels 5*a*. The nozzles 8 are disposed within regions of the lower face of the passage unit 4 opposed to the respective actuator units 21. The nozzles 8 in each region are arranged at regular intervals on a number of straight lines each extending longitudinally of the passage unit 4.

The nozzles 8 are disposed such that projective points obtained by projecting the positions at which the respective nozzles 8 are formed, on an imaginary straight line extending longitudinally of the passage unit 4, perpendicularly to the straight line, are uninterruptedly arranged at regular intervals corresponding to the printing resolution. Thereby, the inkjet head 2 can perform printing uninterruptedly at intervals corresponding to the printing resolution, over substantially the whole area longitudinal of the regions of the passage unit 4 where the nozzles 8 are formed.

A large number of apertures 12 are formed in the passage unit 4. The apertures 12 are disposed in regions opposed to the respective pressure chamber groups 9. In this embodiment, the apertures 12 extend horizontally parallel to each other.

Figure 4:
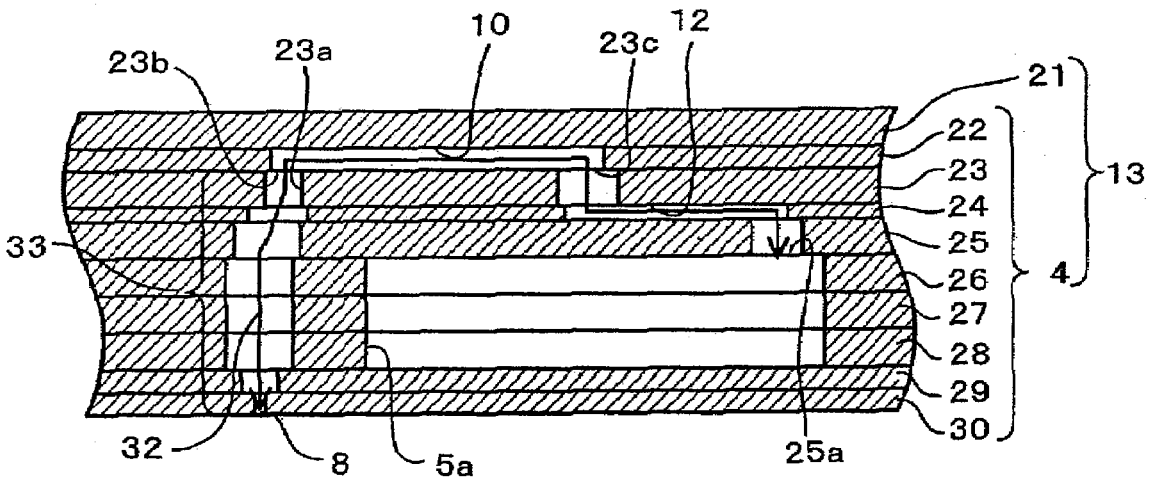
FIG. 4 is a vertically sectional view taken along line IV-IV in FIG. 3.

In the passage unit 4, connection holes are formed so as to connect each corresponding aperture 12, pressure chamber 10, and nozzle 8 with each other. The connection holes are connected with each other to form an individual ink passage 32, as shown in FIG. 4. Each individual ink passage 32 is connected with the corresponding sub manifold channel 5*a*. Ink supplied to each manifold channel 5 is supplied to each individual ink passage 32 via the corresponding sub manifold channel 5*a* and then ejected from the corresponding nozzle 8.

Next, a sectional construction of the head main body 13 will be described. FIG. 4 is a vertically sectional view taken along line IV-IV in FIG. 3.

The passage unit 4 of the head main body 13 has a layered structure in which a number of plates are put in layers. That is, in the order from the upper face of the passage unit 4, there are disposed a cavity plate 22, a base plate 23, an aperture plate 24, a supply plate 25, manifold plates 26, 27, and 28, a cover plate 29, and a nozzle plate 30. A large number of connection holes are formed in each plate. The plates are put in layers after they are positioned so that connection holes formed through the respective plates are connected with each other to form each individual ink passage 32 and each sub manifold channel 5*a*. In the head main body 13, as shown in FIG. 4, the portions constituting each individual ink passage 32 are disposed close to each other at different positions, that is, a pressure chamber 10 is formed near the upper face of the passage unit 4, a sub manifold channel 5*a* is formed in the interior of a middle portion of the passage unit 4, and a nozzle 8 is formed on the lower face of the passage unit 4. Connection holes connect the sub manifold channel 5*a* with the nozzle 8 via the pressure chamber 10.

Connection holes formed through the respective plates will be described. The first is a pressure chamber 10 formed through the cavity plate 22. The second is a connection hole A provided as a second partial passage leading from one end of the pressure chamber 10 to a sub manifold channel 5*a*. The connection hole A is formed through the plates from the base plate 23 as the inlet of the pressure chamber 10 to the supply plate 25 as the outlet of the sub manifold channel 5*a*. The connection hole A includes an aperture 12 formed through the aperture plate 24.

The third is a connection hole B provided as a first partial passage leading from the other end of the pressure chamber 10 to a nozzle 8. The connection hole B is formed through the plates from the base plate 23 as the outlet of the pressure chamber 10 to the nozzle plate 29. In the below, the connection hole B will be referred to as descender 33. The fourth is the nozzle 8 formed through the nozzle plate 30. The nozzle 8 cooperates with the connection hole B to form the descender 33 as the first partial passage. The fifth is a connection hole C to form the sub manifold channel 5*a*. The connection hole C is formed through the manifold plates 26 to 28.

The above connection holes are connected with each other to form an individual ink passage 32 leading from an ink inlet port from the sub manifold channel 5*a*, that is, the outlet of the sub manifold channel 5*a*, to the nozzle 8. Ink supplied to the sub manifold channel 5*a* flows to the nozzle 8 in the following passage. First, ink flows upward from the sub manifold channel 5*a* to one end of the aperture 12. Next, ink horizontally flows longitudinally of the aperture 12 to the other end of the aperture 12. Ink then flows upward from the other end of the aperture 12 to one end of the pressure chamber 10. Ink then horizontally flows longitudinally of the pressure chamber 10 to the other end of the pressure chamber 10. Ink then flows obliquely downward and through three plates to the nozzle 8 just below the connection hole C.

A connection hole 23*a* including the boundary 23*b* between the descender 33 and the pressure chamber 10, and the nozzle 8, are narrower than the other portion of the descender 33. That is, in a section perpendicular to a longitudinal axis of the descender 33, that is, the corresponding portion of a two-headed arrow showing the individual ink passage in FIG. 4, the sectional areas of the connection hole 23*a* and the nozzle 8 are smaller than the sectional area of the other portion of the descender 33. This is a structure in which a proper- oscillation whose both ends are near the nozzle 8 and the connection hole 23*a* is relatively apt to be generated in ink filling up the descender 33.

The area of a section of the aperture 12 perpendicular to a longitudinal axis of the aperture 12, that is, the corresponding portion of the two-headed arrow showing the individual ink passage in FIG. 4, is smaller than either of the area of the connection hole A at the boundary 23*c* with the pressure chamber 10, and the area of the outlet 25*a* of the sub manifold channel 5*a*. Thus, the aperture 12 functions as a restricted passage, and this realizes a structure suitable for ink ejection by a fill-before-fire method.

Figure 5:
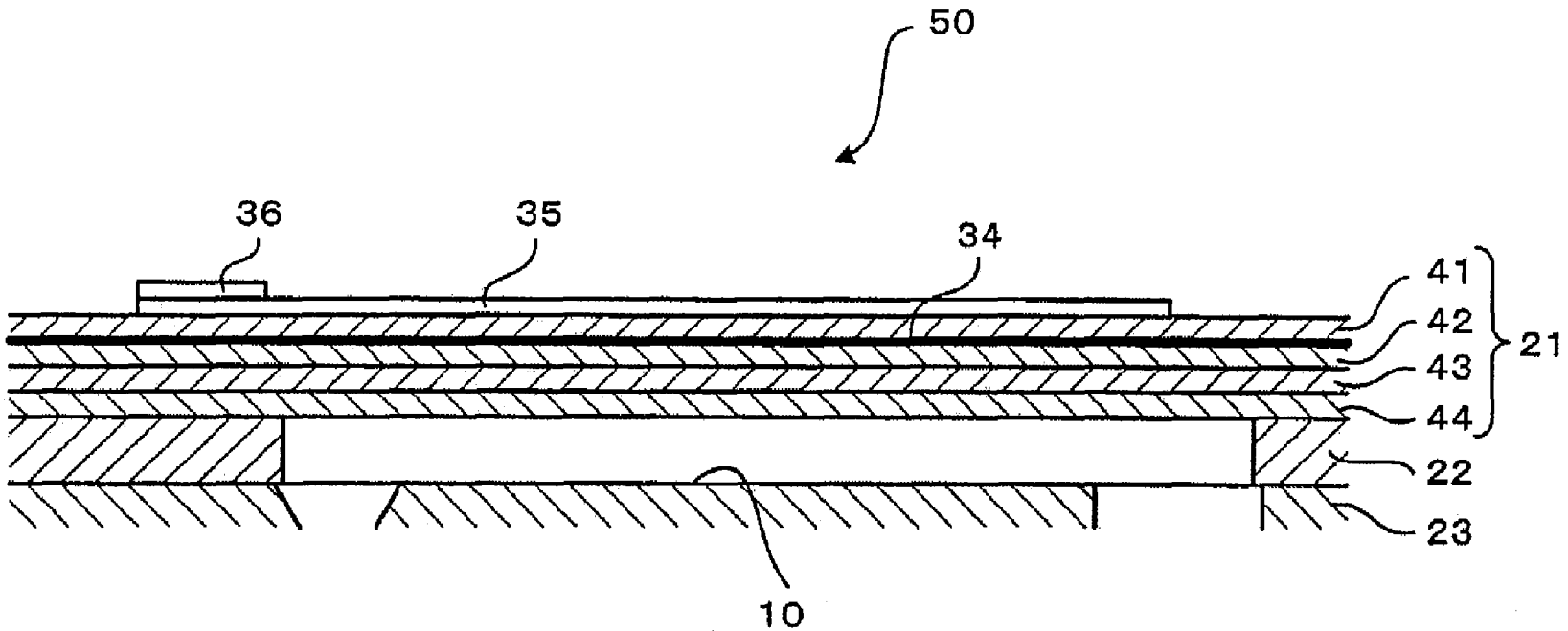
FIG. 5 is a partial enlarged view near a piezoelectric actuator shown in FIG. 4.

As shown in FIG. 5, each actuator unit 21 has a layered structure in which four piezoelectric layers 41, 42, 43, and 44 are put in layers. Each of the piezoelectric layers 41 to 44 has a thickness of about 15 micrometers. The whole thickness of the actuator unit 21 is about 60 micrometers. Any of the piezoelectric layers 41 to 44 is disposed over a large number of pressure chambers 10, as shown in FIG. 3. Each of the piezoelectric layers 41 to 44 is made of a lead zirconate titanate (PZT)-base ceramic material having ferroelectricity.

The actuator unit 21 includes individual electrodes 35 and a common electrode 34, each of which is made of, for example, an Ag—Pd-base metallic material. As described before, each individual electrode 35 is disposed on the upper face of the actuator unit 21 so as to be opposed to the corresponding pressure chamber 10. One end of the individual electrode 35 is extended out of the region opposed to the pressure chamber 10, and a land 36 is formed on the extension. The land 36 is made of, for example, gold containing glass frit. The land 36 has a thickness of about 15 micrometers and is convexly formed. The land 36 is electrically connected to a contact provided on a not-shown flexible printed circuit (FPC). As will be described later, the controller 100 supplies a voltage pulse to each individual electrode 35 via the FPC.

The common electrode 34 is interposed between the piezoelectric layers 41 and 42 so as to spread over substantially the whole area of the interface between the layers. That is, the common electrode 34 spreads over all pressure chambers 10 in the region opposed to the actuator unit 210 The common electrode 34 has a thickness of about 2 micrometers. The common electrode 34 is grounded in a not-shown region to be kept at the ground potential. In this embodiment, a not-shown surface electrode different from the individual electrodes 35 is formed on the piezoelectric layer 41 so as to avoid the group of the individual electrodes 35. The surface electrode is electrically connected to the common electrode 34 through a through hole formed in the piezoelectric layer 41. Like a large number of individual electrodes 35, the surface electrode is connected to another contact and wiring on the FPC 50.

As shown in FIG. 5, each individual electrode 35 and the common electrode 34 are disposed so as to sandwich only the uppermost piezoelectric layer 41. The region of the piezoelectric layer sandwiched by the individual electrode 35 and the common electrode 34 is called an active portion. In each actuator unit 21 of this embodiment, only the uppermost piezoelectric layer 41 includes therein such active portions and the remaining piezoelectric layers 42 to 44 includes therein no active portions. That is, the actuator unit 21 has a so-called unimorph structure.

As will be described later, when a predetermined voltage pulse is selectively supplied to each individual electrode 35, a pressure is applied to ink in the pressure chamber 10 corresponding to the individual electrode 35. Thereby, ink is ejected from the corresponding nozzle 8 through the corresponding individual ink passage 32. That is, a portion of the actuator unit 21 opposed to each pressure chamber 10 serves as an individual piezoelectric actuator 50 corresponding to the pressure chamber 10 and the corresponding nozzle 8. In the layered structure constituted by four piezoelectric layers, such an actuator as a unit structure as shown in FIG. 5 is formed for each pressure chamber 10. Each actuator unit 21 is thus constructed. In this embodiment, the amount of ink to be ejected from a nozzle 8 by one ejection operation is about 5 to 7 pl (picoliters).

On the basis of the above-described structure, each piezoelectric actuator 50 and the corresponding individual ink passage 32 are designed such that the proper oscillation period Ts of oscillation due to integral deformation of the piezoelectric actuator 50 and the corresponding pressure chamber 10, the proper oscillation period Td of ink filling up the corresponding descender 33, and the proper oscillation period Tc of ink filling up the whole of the individual ink passage 32, satisfy the following conditions. That is, Ts/Td is within a range of not less than 0.36 and not more than 0.90 or within a range of not less than 1.1 and not more than 1.7, and $Ts \times Td/Tc^2$ is within a range of not less than 0.0060 and not more than 0.014.

In the above conditions, Ts depends on parameters such as the area, thickness, and material of the corresponding individual electrode 35; the thickness and material of the common electrode 34; the material and thickness of each of the piezoelectric layers 41 to 44; the areas of the regions opposed to the respective pressure chamber 10 and individual electrode 35. In addition, Td depends on parameters such as the shape, length, and sectional area of the descender 33. Further, Tc depends on parameters such as the shape, length, and sectional area of the individual ink passage 32. When designing the individual ink passage 32, for example, proper numerical values are set for the above parameters; then Ts, Td, and Tc are calculated by using fluid analysis or the like; and then it is judged whether or not the calculated Ts, Td, and Tc satisfy the above ranges. By repeating the analysis, the optimum specifications of the individual ink passage 32, the descender 33, and the piezoelectric actuator 50 that satisfy the above ranges are determined. On the basis of the specifications thus determined, each individual ink passage 32, each descender 33, and each piezoelectric actuator 50 of this embodiment, are formed. In this embodiment, in fluid analysis, each descender 33 is considered a straight tube, as will be described later. However, each descender 33 may be considered a combination of tubes different in inner diameter in accordance with the actual shape of the descender 33.

Next, control of the actuator units 21 will be described. For controlling the actuator units 21, the printer 1 includes therein a controller 100 and driver ICs 80. The printer 1 includes therein a central processing unit (CPU) as an arithmetic processing unit; a read only memory (ROM) storing therein computer programs to be executed by the CPU and data used in the programs; and a random access memory (RAM) for temporarily storing data in execution of a computer program.

These components constitute the controller 100 having functions as will be described below.

Figure 6:
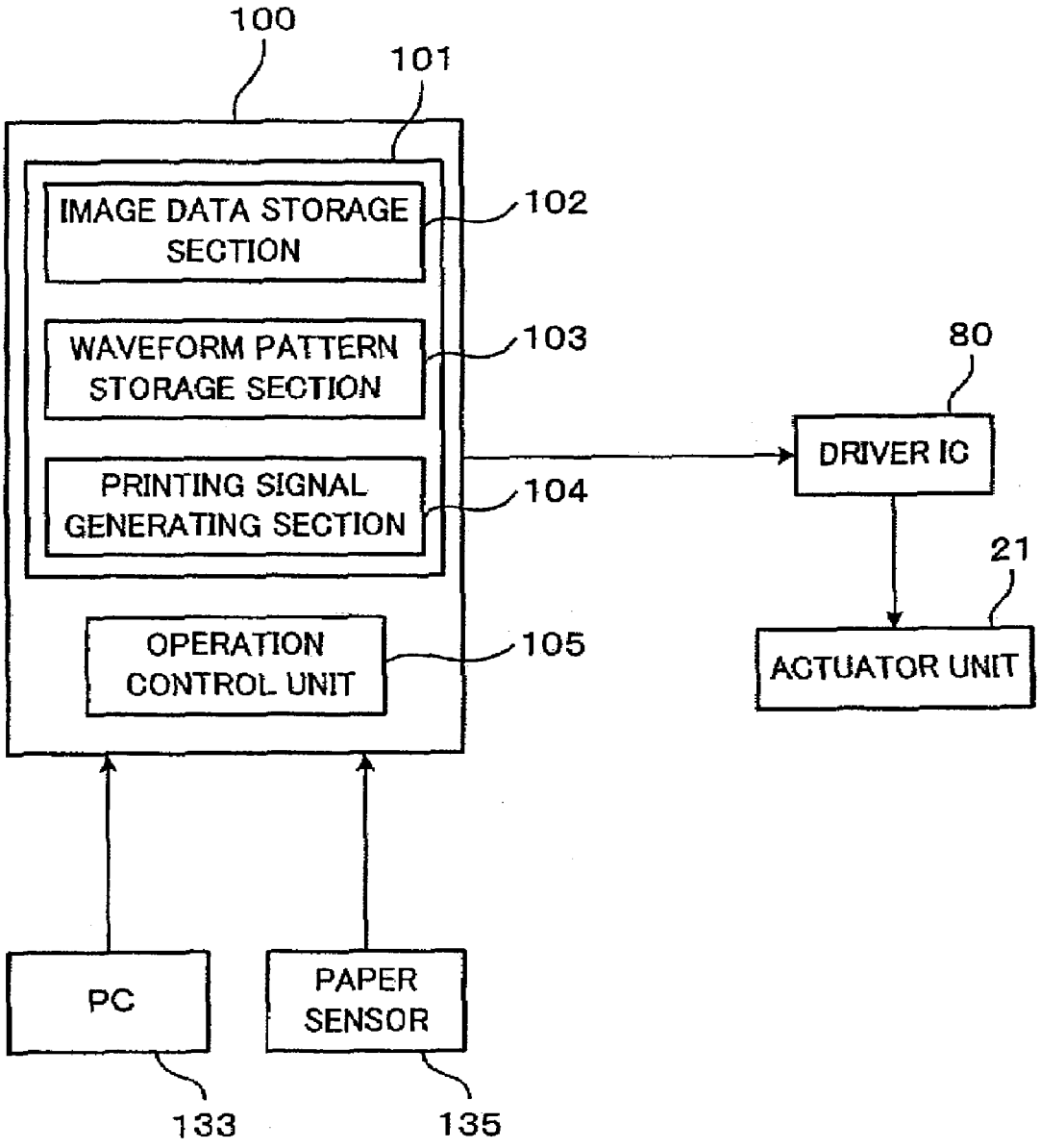
FIG. 6 is a block diagram showing a construction of a controller included in the printer shown in FIG. 1.

As shown in FIG. 6, the controller 100 includes therein a printing control unit 101 and an operation control unit 105. The printing control unit 101 includes therein an image data storage section 102, a waveform pattern storage section 103, and a printing signal generating section 104. The image data storage section 102 stores therein image data for printing, transmitted from, for example, a personal computer (PC) 133.

The waveform pattern storage section 103 stores therein waveform data corresponding to a number of ejection pulse train waveforms. Each ejection pulse train waveform corresponds to a basic waveform in accordance with the tone and so on of an image. A voltage pulse signal corresponding to the waveform is supplied to individual electrodes 35 via the corresponding driver IC 80 and thereby an amount of ink corresponding to each tone is ejected from each inkjet head 2.

The printing signal generating section 104 generates serial printing data on the basis of image data stored in the image data storage section 102. The printing data corresponds to one of data items corresponding to the respective ejection pulse train waveforms stored in the waveform pattern storage section 103. The printing data is for instruction for supplying an ejection pulse train waveform to each individual electrode 35 at a predetermined timing. On the basis of image data stored in the image data storage section 102, the printing signal generating section 104 generates printing data in accordance with timings, a waveform, and individual electrodes, corresponding to the image data. The printing signal generating section 104 then outputs the generated printing data to each driver IC 80.

A driver IC 80 is provided for each actuator unit 21. The driver IC 80 includes a shift register, a multiplexer, and a drive buffer, though any of them is not shown.

The shift register converts the serial printing data output from the printing signal generating section 104, into parallel data. That is, following the instruction of the printing data, the shift register outputs an individual data item to the piezoelectric actuator 50 corresponding to each pressure chamber 10 and the corresponding nozzle 8.

On the basis of each data item output from the shift register, the multiplexer selects appropriate one out of the waveform data items stored in the waveform pattern storage section 103. The multiplexer then outputs the selected data item to the driver buffer.

On the basis of the waveform data item output from the multiplexer, the drive buffer generates a voltage pulse signal having a predetermined level. The drive buffer then supplies the voltage pulse signal to the individual electrode 35 corresponding to each piezoelectric actuator 50, through the FPC.

Next will be described a voltage pulse signal and a change in the potential of an individual electrode 35 having received the signal.

Figure 7:
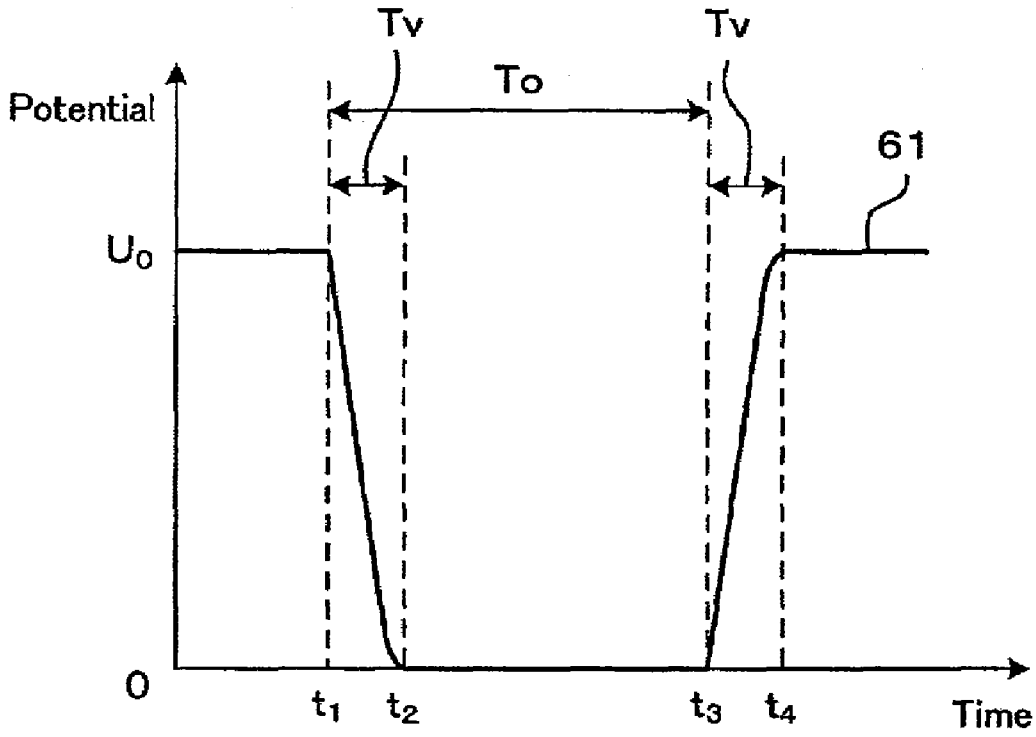
FIG. 7 is a graph showing an example of a change in the potential of an individual electrode to which a voltage pulse signal is supplied.

The voltage at each time contained in the voltage pulse signal will be described. FIG. 7 shows an example of a change in the potential of an individual electrode 35 to which the voltage pulse signal is supplied. The waveform 61 of the voltage pulse signal shown in FIG. 7 is an example of a waveform for ejecting one droplet of ink from a nozzle 8.

At a time t1, the voltage pulse signal starts to be supplied to the individual electrode 35. The time t1 is controlled in accordance with a timing at which ink is ejected from the nozzle 8 corresponding to the individual electrode 35. In the waveform 61 of the voltage pulse signal, the voltage is kept at U0, which is not equal to zero, in the period to the time t1 and in the period after a time t4. In the period from a time t2 to a time t3, the voltage is kept at the ground potential. The period from the time t1 to the time t2 is a transient period in which the potential of the individual electrode 35 changes from U0 to the ground potential. The period from the time t3 to the time t4 is a transient period in which the potential of the individual electrode 35 changes from the ground potential to U0. As shown in FIG. 5, each actuator 50 has the same construction as a capacitor. Thus, when the potential of the individual electrode 35 changes, the above transient periods appear in accordance with accumulation and emission of electric charges.

Next will be described how the piezoelectric actuator 50 is driven when the above voltage pulse signal is supplied to the individual electrode 35.

In each actuator unit 21 of this embodiment, only the uppermost piezoelectric layer 41 has been polarized in the direction from each individual electrode 35 toward the common electrode 34. Thus, when an individual electrode 35 is set at a different potential from the common electrode 34 so as to apply an electric field to the piezoelectric layer 41 in the same direction as that of the polarization, more specifically, in the direction from the individual electrode 35 toward the common electrode 34, the portion to which the electric field has been applied, that is, the active portion, attempts to elongate in the thickness, that is, perpendicularly to the layer. At this time, the active portion attempts to contract parallel to the layer, that is, in the plane of the layer. On the other hand, the remaining three piezoelectric layers 42 to 44 have not been polarized, and they are not deformed by themselves even when an electric field is applied to them.

A difference in distortion is thus generated between the piezoelectric layer 41 and the piezoelectric layers 42 to 44. Therefore, each piezoelectric actuator 50 is deformed as a whole to be convex toward the corresponding pressure chamber 10, that is, to the piezoelectric layers 42 to 44 side, which is called unimorph deformation.

Figure 8A:
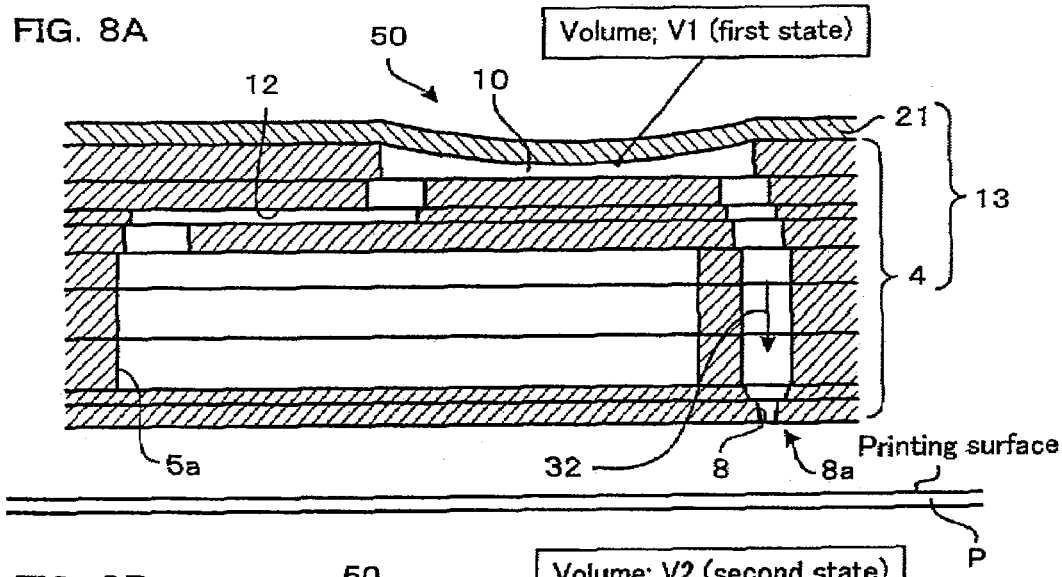
FIGS. 8A, 8B, and 8C show a driving manner of a piezoelectric actuator when the potential of an individual electrode changes as shown in FIG. 7 by supplying a voltage pulse signal.
Figure 8B:
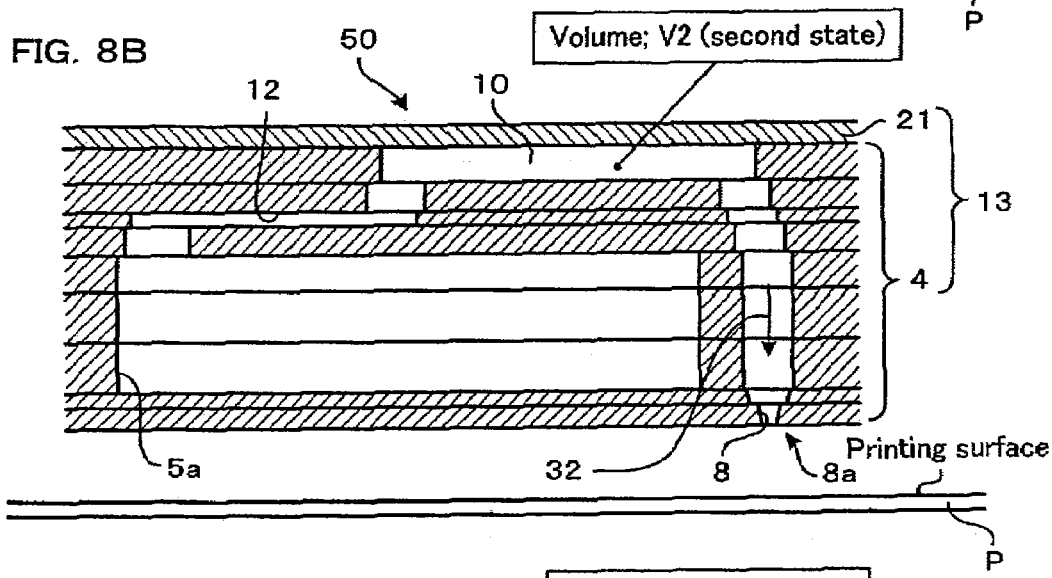
Figure 8C:
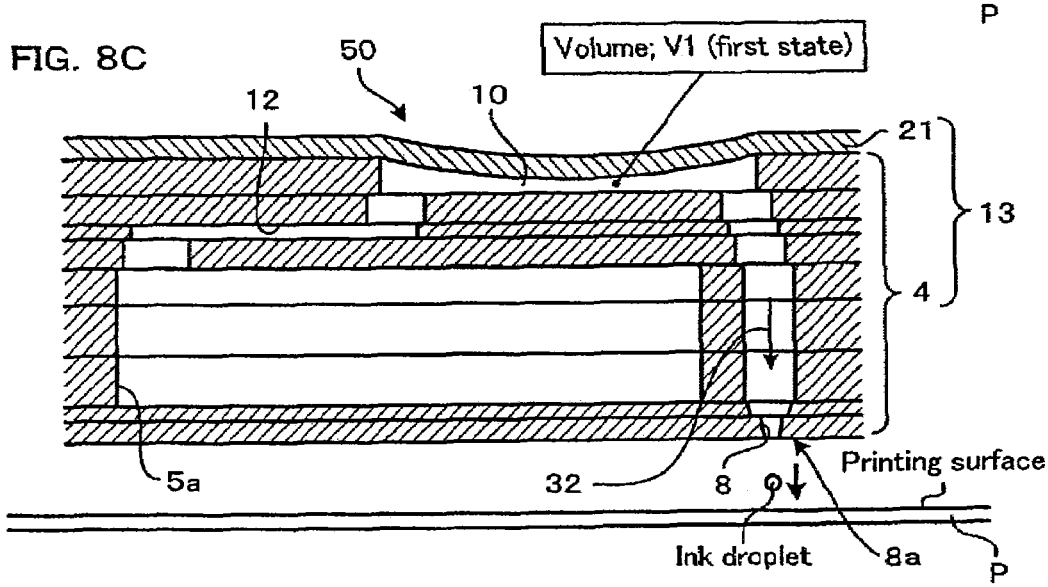

Next will be described drive of a piezoelectric actuator 50 when a voltage pulse signal corresponding to the waveform 61 is supplied to the corresponding individual electrode 35. FIGS. 8A to 8C show a change in the piezoelectric actuator 50 with time.

FIG. 8A shows the state of the piezoelectric actuator 50 in the period to the time t1 shown in FIG. 7. At this time, the potential of the individual electrode 35 is U0. The piezoelectric actuator 50 protrudes into the corresponding pressure chamber 10 by the above-described unimorph deformation. The volume of the pressure chamber 10 at this time is V1. This state of the pressure chamber 10 will be referred to as a first state.

FIG. 8B shows the state of the piezoelectric actuator 50 in the period from the time t2 to the time t3 shown in FIG. 7. At this time, the individual electrode 35 is at the ground potential. Therefore, the electric field disappears that was applied to the active portion of the piezoelectric layer 41, and the piezoelectric actuator 50 is released from its unimorph deformation. The volume V2 of the pressure, chamber 10 at this time is larger than the volume V1 of the pressure chamber 10 shown in FIG. 8A. This state of the pressure chamber 10 will be referred to as a second state. As a result of an increase in the volume of the pressure chamber 10., ink is sucked into the pressure chamber 10 from the corresponding sub manifold channel 5*a*.

FIG. 8C shows the state of the piezoelectric actuator 50 in the period after the time t4 shown in FIG. 7. At this time, the potential of the individual electrode 35 is U0. Therefore, the piezoelectric actuator 50 has been again restored to the first state. By the piezoelectric actuator 50 thus changing the pressure chamber 10 from the second state into the first state, a pressure is applied to ink in the pressure chamber 10. Thereby, an ink droplet is ejected from the corresponding nozzle B. The ink droplet impacts the printing surface of a printing paper P to form a dot.

As described above, in the drive of the piezoelectric actuator 50 of this embodiment, first, the volume of the pressure chamber 10 is once increased to generate a negative pressure wave in ink in the pressure chamber 10, as shown from FIG. 8A to FIG. 8B. The pressure wave is reflected by an end of the ink passage in the passage unit 4, and thereby returned as a positive pressure wave progressing toward the nozzle 8. With estimating a timing at which the positive pressure wave reaches the interior of the pressure chamber 10, the volume of the pressure chamber 10 is again decreased, as shown from FIG. 8B to FIG. 8C. This is a so-called fill-before-fire method.

In order to realize ink ejection by the above-described fill-before-fire method, the pulse width To of the voltage pulse having the waveform 61 for ink ejection, as shown in FIG. 7, is adjusted to 1 AL (acoustic length). In this embodiment, each pressure chamber 10 is provided near the center of the whole length of the corresponding individual ink passage 32, and AL is the length of a time period for which a pressure wave generated in the pressure chamber 10 progresses from the corresponding aperture 12 to the corresponding nozzle 8. In this construction, the positive pressure wave reflected as described above is superimposed on a positive pressure wave generated because of deformation of the corresponding piezoelectric actuator 50 so that a higher pressure is applied to ink. Therefore, in comparison with a case wherein the volume of the pressure chamber 10 is decreased only one time to push ink out, the driving voltage for the piezoelectric actuator 50 is held down when the same amount of ink is ejected. Thus, the fill-before-fire method is advantageous in high integration of pressure chambers 10, compactification of an inkjet head 2, and the running cost for driving the inkjet head 2.

Next will be described analysis performed by the inventors of the present invention.

Figure 9A:
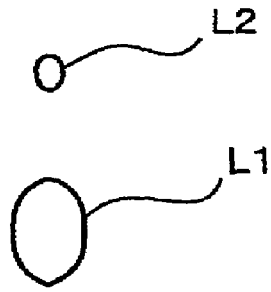
FIGS. 9A, 9B, and 9C show ink droplets ejected from a nozzle when a voltage pulse corresponding to FIG. 7 is supplied to an individual electrode.

The inventors of the present invention confirmed that a conventional inkjet head has the following problem. FIG. 9A shows, by way of example, ink droplets ejected from a nozzle of an inkjet head having the construction as shown in FIGS. 2 to 5, by a voltage pulse adjusted to To=AL. To ensure the reproducibility of an image to be printed on the basis of image data, appropriate amounts of ink droplets must impact at respective appropriate positions in accordance with the image data. For this purpose, any nozzle ideally ejects a desired number of ink droplets at a desired ejection speed in each ink ejection operation. In an inkjet head of the above embodiment, an ideal condition is that two ink droplets L1 and L2 are successively ejected at a predetermined speed in each time of ejection, as shown in FIG. 9A.

Figure 9C:
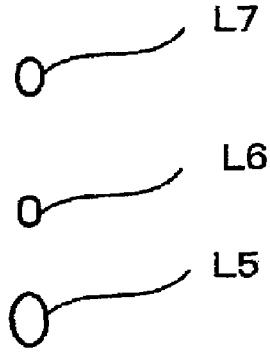
Figure 9B:
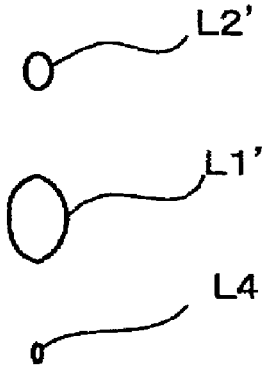

FIGS. 9B and 9C show other cases of ink droplets ejected under the same conditions. In the case of FIG. 9B, there is generated another ink droplet L4 than ideal two ink droplets. Also in the case of FIG. 9*c*, there are generated three ink droplets L5, L6, and L7. Such generation of three ink droplets in total is because a portion of an ink droplet is split off from the original two ink droplets. When an ink droplet is thus generated that differs from ideal two ink droplets, the ink droplet having its volume different from a desired volume impacts at a position different from each dot of the image data. This reduces the reproducibility of the image to be formed by the inkjet head.

It is understood that the above problem is mainly caused by the structure of each ink passage and does not particularly depend on the kind of the actuator or the like.

The inventors of the present invention thought that splitting off an ink droplet from a desired ink droplet as described above is by the following cause.

In ink ejection using a so-called fill-before-fire method, first, a negative pressure is applied to ink in each pressure chamber 10. A negative pressure wave thus generated is reflected by the corresponding aperture 12 to become a positive pressure wave. At a timing when the positive pressure wave returns to the pressure chamber 10, a positive pressure is applied to the pressure chamber 10, as shown in FIG. 4. By thus superimposing the pressure waves generated in ink filling up the individual ink passage 32, ink is efficiently ejected.

On the other hand, it is thinkable that applying a pressure by the piezoelectric actuator 50 may cause not only a progressive wave in ink in the individual ink passage 32 but also a local proper oscillation in ink in a region of the individual ink passage 32. The inventors of the present invention thought that the local proper oscillation causes splitting off an ink droplet as described above. That is, because a peak of a pressure wave generated due to the local proper oscillation overlaps a peak of the above progressive wave in the nozzle 8, the ejection speed of ink increases in comparison with a case of no local proper oscillation. As a result, a tip portion of an ink droplet is split off from the main body of the ink droplet to generate a high-speed small ink droplet.

More details of the above phenomenon are as follows. In ink ejection, when a pressure wave is generated in ink filling up a pressure chamber 10 due to deformation of the corresponding piezoelectric actuator 50, the pressure wave progresses both upstream and downstream in the pressure chamber 10. In a fill-before-fire method, the volume of the pressure chamber 10 is once increased and then the pressure chamber 10 is again restored to its original volume after a time corresponding to the pulse width To elapses, to eject ink from the corresponding nozzle. First, when the volume of the pressure chamber 10 is increased, a negative pressure wave is generated in ink in the pressure chamber 10, which wave will be referred to as a first pressure wave. Successively, when the volume of the pressure chamber 10 is decreased, a positive pressure wave is generated, which will be referred to as a second pressure wave.

Parts of the pressure waves progress downstream into the descender 33, as described above. For example, the first pressure wave having progressed into the descender 33 is reflected by both ends of the descender 33, that is, by the boundary between the pressure chamber 10 and the descender 33 and a portion near the nozzle 8. The reflected waves induce a proper oscillation in ink filling up the descender 33. This proper oscillation generated in the descender 33 is an example of the above-described local proper oscillation.

On the other hand, part of the first pressure wave progresses upstream in the pressure chamber 10 toward the corresponding sub manifold channel 5*a*. The first pressure wave is reflected by the aperture 12 in the middle of the passage to become a pressure wave in which the sign of the pressure has inverted. The pressure wave having inverted in the sigh of the pressure progresses through the pressure chamber 10 and the descender 33 toward the nozzle 8. That is, the first pressure wave inverts in the sign of the pressure when reflected by the aperture 12, and the reflected pressure wave returns to the pressure chamber 10 as a positive pressure wave, which will be referred to as a third pressure wave. The piezoelectric actuator 50 then generates the second pressure wave in ink in the pressure chamber 10. When a composite wave in which the second pressure wave has been superimposed on the third pressure wave to form a progressive wave, reaches the nozzle 8, ink is ejected from the nozzle 8.

Further, parts of the second and third pressure waves are superimposed on the proper oscillation generated in the descender 33 due to the first pressure wave. That is, any of the first to third pressure waves contributes the proper oscillation in the descender 33. Thus, when the progressive wave composed of the second and third pressure waves reaches the nozzle 8, the oscillation in which all of (1) the contribution by the progressive wave itself; (2) the contribution by the first pressure wave to the proper oscillation in the descender 33; and (3) the contribution by parts of the second and third pressure waves to the proper oscillation in the descender 33, have been superimposed on each other, are observed in the nozzle 8.

It is thinkable that the oscillation in which the above-described contributions have been superimposed on each other in the nozzle 8, causes an increase in the ejection speed of ink to be ejected from the nozzle 8, so that a tip portion of an ink droplet is split off from the main body of the ink droplet. Therefore, if the proper oscillation is suppressed in ink filling up the descender 33, the superimposition in the oscillation does not occur in the nozzle 8 and ink is prevented from increasing in its ejection speed.

On the other hand, the proper oscillation induced in ink in the descender 33 is caused by the pressure applied by the piezoelectric actuator 50 to ink in the pressure chamber 10. Therefore, it is expected that the inducibility of the proper oscillation in the descender 33 varies in accordance with the proper oscillation period of the oscillation when the piezoelectric actuator 50 is deformed integrally with the pressure chamber 10. That is, when ink is ejected from an inkjet head in which the proper oscillation period when the piezoelectric actuator 50 oscillates integrally with the pressure chamber 10, is near the proper oscillation period of the descender 33, a pressure wave generated due to the integral deformation of the piezoelectric actuator 50 and the pressure chamber 10 is apt to induce a proper oscillation in the descender 33, that is, resonance in the descender 33. Contrastingly, when the proper oscillation period when the piezoelectric actuator 50 oscillates integrally with the pressure chamber 10, widely differs from the proper oscillation period of the descender 33, a pressure wave generated due to the integral deformation of the piezoelectric actuator 50 and the pressure chamber 10 is hard to induce a proper oscillation in the descender 33.

Figure 10A:
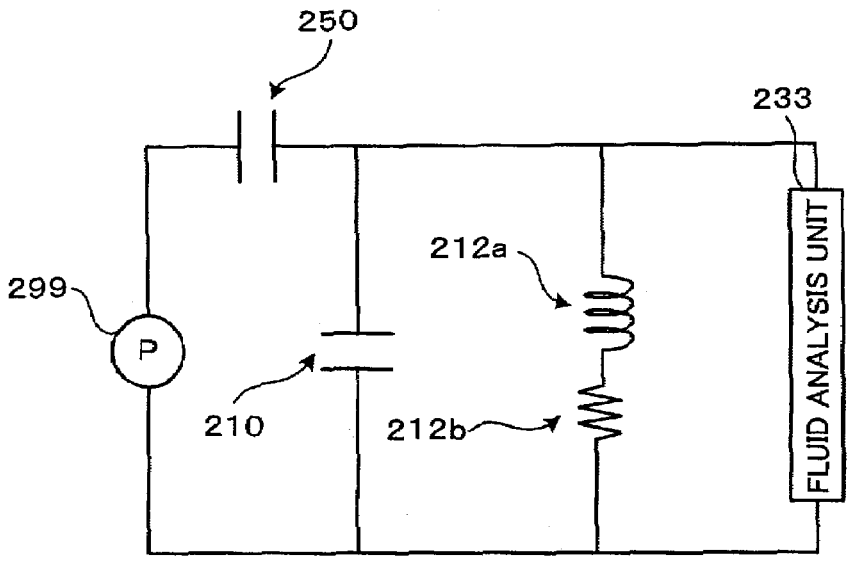
FIG. 10A shows an equivalent circuit obtained by modeling an individual ink passage shown in FIG. 4, used in analysis by the inventors of the present invention.
Figure 10B:
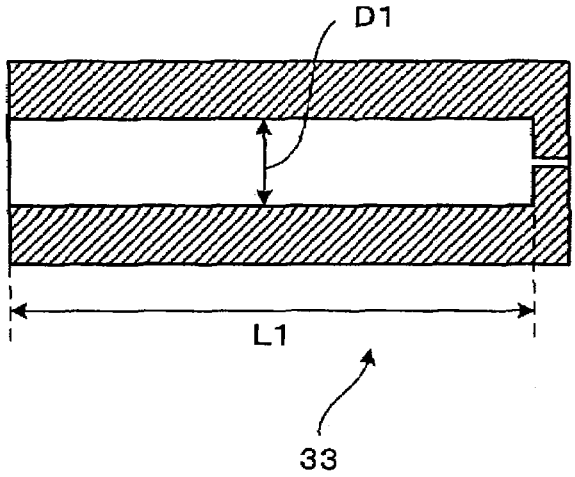
FIG. 10B shows a structure of a first partial passage in a fluid analysis unit shown in FIG. 10A.
Figure 10C:
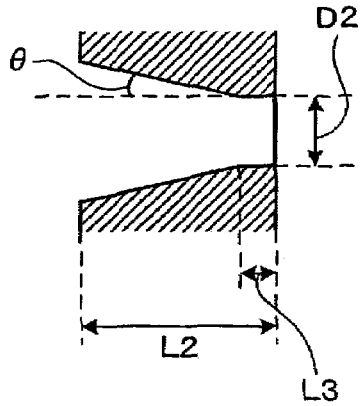
FIG. 10C shows a structure of a nozzle in the first partial passage shown in FIG. 10B.

For confirming the above, the inventors of the present invention carried out the following numeric analysis. FIGS. 10A to 10C are for explaining the numeric analysis.

In the numeric analysis, a circuit is constructed by acoustically equivalent conversion of an individual ink passage as shown in FIG. 4, that is, a passage leading from the ink inlet port from a sub manifold channel 5*a* to a nozzle 8. The equivalent circuit was acoustically analyzed. FIG. 10A shows the equivalent circuit.

The equivalent circuit as will be described below corresponds to an ink passage and an actuator as shown in, for example, FIGS. 4, and 5. In the below description, therefore, the terms of the descender 33, the piezoelectric actuator 50, and so on, as shown in, for example, FIGS. 4 and 5, will be used. However, information on, for example, the actuator shown in FIG. 5, necessary for the numeric analysis, is compliance. Therefore, in any actuator having the same compliance to apply a pressure to ink in a pressure chamber, the same results of the numeric analysis are obtained. That is, the results obtained by the numeric analysis as will be described below can apply to not only the passage unit 4 and the piezoelectric actuator 4 shown in, for example, FIGS. 4 and 5, but also any inkjet head that satisfies the conditions used in the numeric analysis.

The aperture 12 corresponds to a coil 212*a* and a resistor 212*b* in the circuit of FIG. 10A. The piezoelectric actuator 50 and the pressure chamber 10 correspond to a capacitor 250 and a capacitor 210 in the circuit of FIG. 10A, respectively. The descender 33 and the nozzle 8 correspond to a fluid analysis unit 233 in the circuit of FIG. 10A. The fluid analysis unit 233 is not considered a mere capacitor, resistance, or the like, in the circuit. The fluid analysis unit 233 is numerically analyzed separately by fluid analysis as will be described below.

In acoustic analysis in the numerical analysis, there are used the thickness of the piezoelectric actuator 50; the area and the depth, which is perpendicularly to the piezoelectric layers, of the pressure chamber 10; the width, the length, and the depth, which is perpendicularly to the piezoelectric layers, of the aperture 12; and so on. The compliance of the piezoelectric actuator 50, which is an acoustic capacitance corresponding to the capacitance of the capacitor 250 in the equivalent circuit, and the constant of pressure to be generated by the piezoelectric actuator 50, have been obtained in advance by a finite element technique from the above data of the piezoelectric actuator 50 and so on. The piezoelectric constant has been obtained by using a resonance method in which the impedance of a piezoelectric element is measured.

As described above, the fluid analysis unit 233 corresponds to the descender 33. FIG. 10B shows a whole structure of the descender 33, as shown in FIG. 4, in a form used in fluid analysis of the fluid analysis unit 233. FIG. 10C shows a structure of a portion of the nozzle plate 30 in the descender 33. The left end of FIG. 10B is connected with the pressure chamber 10.

In the fluid analysis, six inkjet heads are prepared that are different in inner diameters and lengths of the descender 33 and the thickness of an oscillating plate included in the piezoelectric actuator 50. In each of the inkjet heads a to f, inner diameters D1 and D2 and lengths L1, L2, and L3 of portions of the descender 33 are shown in Tables 1 and 2, which will be given below. The inner diameter D1 corresponds to the inner diameter of a portion of the descender 33 formed in the plates other than the nozzle plate 30. The inner diameter D2 corresponds to the inner diameter of the nozzle 8. In the numeric analysis, as shown in FIG. 10B, the portion of the descender 33 formed in the plates other than the nozzle plate 30 has the same inner diameter at any position. As shown in FIG. 10C, the portion formed in the nozzle plate 30 has a structure tapered toward the nozzle 8. A portion in the range of the length L3 near the nozzle 8 has the same inner diameter D2 at any position. The inner surface of the tapered portion and the inner surface of the portion near the nozzle 8 form an angle of 8 degrees in the sectional view of FIG. 10C, as shown in Table 2.

In each of the inkjet heads a to f, the thickness of the oscillating plate is shown in Table 1. The oscillating plate corresponds to the piezoelectric layers 42 to 44 shown in FIG. 5. The proper oscillation period Ts of the integral oscillation of the piezoelectric actuator 50 and the pressure chamber 10 is calculated from the thickness of the oscillating plate. The proper oscillation period Ts of each of the inkjet heads a to f is shown in Table 1 by the microsecond. In each inkjet head, cases were analyzed wherein the length L1 was set to 200 micrometers, 400 micrometers, 600 micrometers, 800 micrometers, and 1000 micrometers, (1 micrometer=$10^{-6}$m). Table 3 shows by the microsecond the proper oscillation period Td of ink filling up the descender 33 in accordance with each value of the length L1.

It was supposed that each of the inkjet heads a to f ejected ink by a driving voltage shown in Table 1. The driving voltage corresponds to the height of a voltage pulse supplied to the individual electrode 35 of the piezoelectric actuator 50. That is, the driving voltage indicates the maximum potential difference U0 between the individual electrode 35 and the common electrode 34, as shown in FIG. 7.

TABLE 1

| | Thickness of oscillating plate [μm] | Ts [μsec] | L1 [μm] | Driving voltage [V] |
|---|---|---|---|---|
| Head a | 60 | 0.774 | 200, | 26.7 |
| Head b | 55 | 0.940 | 400, | 23.5 |
| Head c | 50 | 1.10 | 600, | 21.4 |
| Head d | 45 | 1.31 | 800, | 20.3 |
| Head e | 40 | 1.56 | 1000 | 19.2 |
| Head f | 35 | 1.96 | | 17.9 |

TABLE 2

| D1 | D2 | L2 | L3 | θ |
|---|---|---|---|---|
| 220 μm | 20 μm | 50 μm | 10 μm | 8 deg |

TABLE 3

| | L1 | | | | |
|---|---|---|---|---|---|
| | 200 μm | 400 μm | 600 μm | 800 μm | 1000 μm |
| Td [μ sec] | 0.520 | 1.04 | 1.44 | 1.89 | 2.20 |

The following Table 4 shows Ts/Td in accordance with each inkjet head and each value of L1. The following Table 5 shows by the microsecond the proper oscillation period Tc of ink filling up the whole of the individual ink passage 32 in accordance with each inkjet head and each value of L1.

TABLE 4

| | L1 = 200 μm | 400 μm | 600 μm | 800 μm | 1000 μm |
|---|---|---|---|---|---|
| Head a | 1.49 | 0.74 | 0.54 | 0.41 | 0.35 |
| Head b | 1.81 | 0.90 | 0.65 | 0.50 | 0.43 |
| Head c | 2.11 | 1.05 | 0.76 | 0.58 | 0.50 |
| Head d | 2.52 | 1.26 | 0.91 | 0.69 | 0.60 |
| Head e | 3.00 | 1.50 | 1.09 | 0.83 | 0.71 |
| Head f | 3.67 | 1.84 | 1.33 | 1.01 | 0.87 |

TABLE 5

| | L1 = 200 μm | 400 μm | 600 μm | 800 μm | 1000 μm |
|---|---|---|---|---|---|
| Head a | 12.6 | 12.8 | 13.0 | 13.2 | 13.5 |
| Head b | 12.9 | 13.1 | 13.3 | 13.5 | 13.7 |
| Head c | 13.3 | 13.5 | 13.7 | 13.9 | 14.1 |
| Head d | 13.9 | 14.1 | 14.3 | 14.5 | 14.7 |
| Head e | 14.6 | 14.8 | 15.0 | 15.2 | 15.4 |
| Head f | 15.5 | 15.7 | 15.9 | 16.1 | 16.3 |

The fluid analysis was performed in the fluid analysis unit 233 by the quasi compressibility method as a fluid analysis method formulated by quasi compressibility. The quasi compressibility method is a method for obtaining velocity and pressure by making the Navier-Stokes equation simultaneous with an equation of continuity in which a term representing a quasi time change in density has been added.

The compliance of the pressure chamber 10, which is an acoustic capacitance C corresponding to the capacitance of the capacitor 210 in the equivalent circuit, was obtained by a relational expression C=W/Ev, where W represents the volume of the pressure chamber 10 and Ev represents the volume elasticity of ink.

The inertance of the aperture 12, corresponding to the inductance of the coil 212*a* in the equivalent circuit, was obtained by a relational expression m=rho×1/A, where rho represents the ink density; A represents the area of a section of the aperture 12 perpendicular to a longitudinal axis of the aperture, that is, horizontal in FIG. 4; and 1 represents the length of the aperture 12 horizontal in FIG. 4.

The passage resistance of the aperture 12, corresponding to the resistance R of the resistor 212*b*, was obtained as follows. In the above-described embodiment, each aperture 12 has a rectangular shape having its sides of a length of 2*a* and sides of a length of 2*b*, in a sectional view perpendicular to a longitudinal axis of the aperture, that is, horizontal in FIG. 4. In this case, the quantity of ink flowing in the aperture 12 is obtained by the following Expression 1. The relation between the pressure delta p to be applied in the aperture 12, corresponding to the intensity of the pressure wave, and the quantity Q of ink flowing in the aperture 12, is expressed by Q=delta p/R. The resistance R is calculated from the relation and Expression 1. In Expression 1, 1 represents the length of the aperture 12, as described above.

$$Q = \frac{4ab^3\Delta p}{3\mu l}\left[1 - \frac{192b}{\pi^5 a}\sum_{m=1,3,\ldots}^{\infty}\frac{1}{n^5}\tanh\left(\frac{n\pi a}{2b}\right)\right] \quad \text{[Expression 1]}$$

In the fluid analysis in the fluid analysis unit 233, the volume velocity of ink passing through the fluid analysis unit 233 is obtained. As a condition corresponding to the voltage to be applied between the individual electrode 35 and the common electrode 34 in the piezoelectric actuator 50, it was supposed that a pressure P corresponding to the voltage was applied by a pressure source 299 in the circuit. Under the above-described conditions, the volume velocity of ink flowing through the circuit was obtained by numeric analysis on the basis of the pressure P, the acoustic capacitance, the inertance, and the resistance; and analysis results in the fluid analysis unit obtained by separate numeric analysis. The following Table 6 shows results of the numeric analysis of the volume velocity of ink.

TABLE 6

| | Ts/Td | Speed of first droplet [m/sec] | Speed of second droplet [m/sec] | Speed of third droplet [m/sec] |
|---|---|---|---|---|
| Head a | 1.49 | 8.7 | 5.6 | — |
| | 0.74 | 8.5 | 5.7 | — |
| | 0.54 | 7.6 | 5.4 | — |
| | 0.41 | 7.4 | 5.2 | — |
| | 0.35 | 7.2 | 4.4 | 3.1 |
| Head b | 1.81 | 7.8 | 5.7 | 4.4 |
| | 0.90 | 8.2 | 5.4 | — |
| | 0.65 | 7.6 | 5.5 | — |
| | 0.50 | 7.4 | 5.7 | 3.6 |
| | 0.43 | 7.7 | 5.6 | — |
| Head c | 2.11 | 9.2 | 6.9 | 4.3 |
| | 1.05 | 10.7 | 5.7 | 3.8 |
| | 0.76 | 7.5 | 5.7 | — |
| | 0.58 | 7.4 | 6.4 | 4.8 |
| | 0.50 | 7.2 | 5.4 | 3.2 |

TABLE 6-continued

| | Ts/Td | Speed of first droplet [m/sec] | Speed of second droplet [m/sec] | Speed of third droplet [m/sec] |
|---|---|---|---|---|
| Head d | 2.52 | — | — | — |
| | 1.26 | 7.8 | 5.7 | — |
| | 0.91 | 10.2 | 6.2 | 3.7 |
| | 0.69 | 7.2 | 5.3 | — |
| | 0.60 | 7.3 | 5.4 | — |
| Head e | 3.00 | — | — | — |
| | 1.50 | 7.6 | 5.8 | — |
| | 1.09 | 10.4 | 6.6 | 4.1 |
| | 0.83 | 7.8 | 6.1 | — |
| | 0.71 | 6.9 | 5.0 | — |
| Head f | 3.67 | — | — | — |
| | 1.84 | 7.4 | 4.3 | 2.4 |
| | 1.33 | 7.9 | 5.8 | — |
| | 1.01 | 12.5 | 6.6 | 3.9 |
| | 0.87 | 6.4 | 5.0 | — |

Table 6 shows, by m/sec, the ejection speeds of inks ejected from the inkjet heads corresponding to the respective values of Ts/Td shown in FIG. 4. As shown in Table 6, the values of Ts/Td resulted in two different cases, that is, a case wherein two ink droplets were ejected and a case wherein three ink droplets were ejected.

Figure 11:
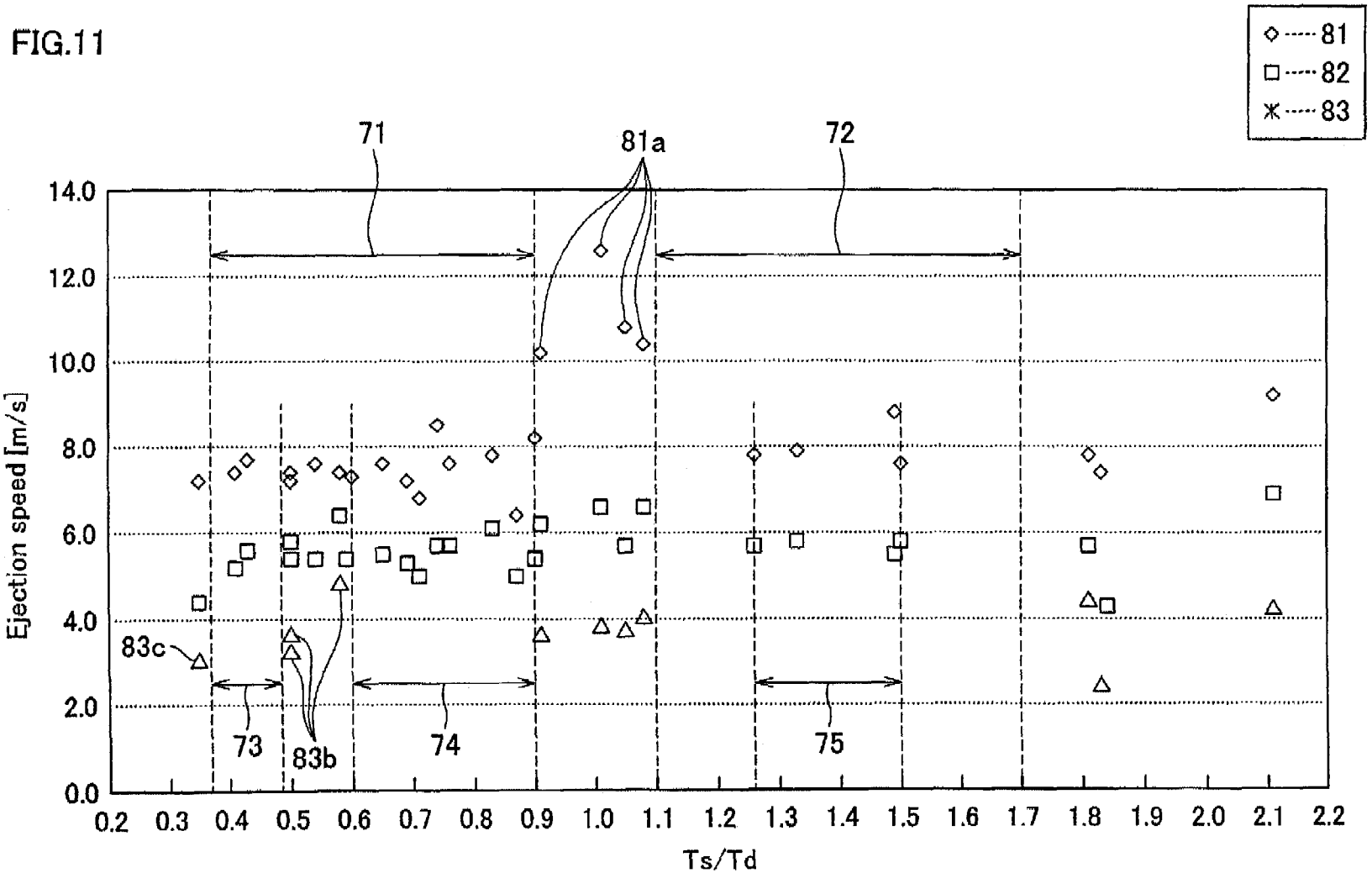
FIG. 11 is a graph showing results of numeric analysis performed by using the model shown in FIGS. 10A to 10C.

FIG. 11 is a graph showing the results of Table 6. In FIG. 11, the axis of abscissas represents Ts/Td, and the axis of ordinate represents the ejection speed of an ink droplet by m/sec. Points 81, 82, and 83 plotted in the graph of FIG. 11 correspond first, second, and third ink droplets, respectively.

As shown by points 81*a* in FIG. 11, in the range of Ts/Td from 0.90 to 1.1, three ink droplets in total are generated, and the ejection speed of the first droplet is considerably high in comparison with that in any other range. That is, each point 81*a* represents a high-speed ink droplet generated by being split off from the original ink droplet, as shown in FIG. 9B.

The above-described analysis shows that the above-described problem is resolved when an inkjet head is constructed such that Ts and Td satisfy the condition that Ts/Td is not less than 0.36 and not more than 0.90; or not less than 1.1 and not more than 1.7. In the condition, Ts represents the proper oscillation period of the oscillation due to integral deformation of the actuator and the pressure chamber. Td represents the proper oscillation period of ink filling up the first partial passage from the outlet of the pressure chamber to the ejection port in the individual ink passage.

The oscillation due to integral deformation of the actuator and the pressure chamber is as follows. When the actuator is driven, the actuator is deformed integrally with the corresponding pressure chamber. At this time, when the actuator changes stepwise between the first and second states, the actuator and the pressure chamber oscillate integrally and the integral oscillation gradually attenuates because of the elasticity of the actuator and the pressure chamber.

The equilibrium state of the oscillation corresponds to a state wherein the attenuation of the oscillation has been completed and the actuator and the pressure chamber are not deformed, that is, a state wherein the actuator is not deformed. For example, in the case of the piezoelectric actuator 50 as shown in FIG. 5, the equilibrium state of the oscillation corresponds to a state wherein the potential difference between the individual electrode 35 and the common electrode 34 is zero, that is, the state shown in FIG. 8B. This is because no piezoelectric distortion is generated in the piezoelectric actuator 50 when the potential difference between the electrodes is zero, and therefore, the piezoelectric actuator 50 is not deformed.

When the actuator changes between the first and second states, a pressure is applied to ink in the pressure chamber. In the ink ejection operation, the above-described integral oscillation of the actuator and the pressure chamber is generated. Therefore, the pressure applied to ink in the pressure chamber is strongly influenced by the proper oscillation caused by the integral oscillation of the actuator and the pressure chamber. In addition, the pressure wave generated in ink in the pressure chamber induces the proper oscillation of ink in the first partial passage. Therefore, the proper oscillation of ink in the first partial passage is also strongly influenced by the proper oscillation caused by the integral oscillation of the actuator and the pressure chamber. That is, if the proper oscillation period Ts of the integral oscillation of the actuator and the pressure chamber is near the proper oscillation period Td of ink in the first partial passage, the proper oscillation of ink in the first partial passage is apt to be generated. This is apt to cause that an ink droplet ejected from the nozzle splits.

On the basis of the above-described analysis, in each inkjet head 2 of the above-described embodiment, the value of Ts/Td has been controlled to fall within a range 71, in which Ts/Td is not less than 0.36 and not more than 0.90, or a range 72, in which Ts/Td is not less than 1.1 and not more than 1.7, except the range containing the points 81*a* each representing a high-speed ink drop let generated because a tip portion of the original ink droplet is split off from the main body of the original ink droplet. This improves the reproducibility of an image to be formed by each inkjet head 2.

When Ts/Td is less than the lower limit of the range 71, the modes of the third and more orders in the proper oscillation of ink in the first partial passage becomes an issue. However, the case wherein the modes of the third and more orders in the proper oscillation of ink in the first partial passage becomes an issue, is a case wherein the compliance of the actuator is extremely low or a case wherein the descender is extremely long. Thus, when Ts/Td is below the range 71, the pressure efficiency lowers. This is undesirable in design. In addition, as shown by a point 83*c* in FIG. 11, Ts/Td below the range 71 may cause generation of a third ink droplet that is thinkable to be generated due to the modes of the third and more orders in the proper oscillation of ink in the first partial passage. For this reason, the range below the rang 71 is excluded from the above-described ranges of the embodiment.

On the other hand, when the proper oscillation period of the integral oscillation of the actuator and the pressure chamber exceeds 1.7 times the proper oscillation period of the first partial passage, a sufficient volume of the first partial passage can not be ensured, and the oscillation in the first partial passage is apt to influence the meniscus. Contrastingly, when the proper oscillation period of the integral oscillation of the actuator and the pressure chamber is below 1.7 times the proper oscillation period of the first partial passage, attenuation of the oscillation in the first partial passage prevents the oscillation from directly influencing the meniscus. For this reason, in the above-described embodiment, the proper oscillation period of the integral oscillation of the actuator 50 and the pressure chamber 10 is set within a range below 1.7 times the proper oscillation period of the descender 33.

Each inkjet head is preferably constructed such that Ts/Td satisfies a condition that Ts/Td is not less than 0.36 and not more than 0.90; or not less than 1.26 and not more than 1.5, which is a range 75 shown in FIG. 11. In this construction, as shown in FIG. 11, Ts/Td falls within a range in which only two ink droplets are ejected more surely.

In another case, each inkjet head is preferably constructed such that Ts/Td satisfies a condition that Ts/Td is not less than 0.36 and not more than 0.48; not less than 0.60 and not more than 0.90; or not less than 1.1 and not more than 1.7. Points 83*b* shown in FIG. 11 indicate that an ink droplet is generated by being split off from the original ink droplet in the range between a range 73, in which Ts/Td is not less than 0.36 and not more than 0.48, and a range 74, in which Ts/Td is not less than 0.60 and not more than 0.90. That is, in the range between the ranges 73 and 74, three ink droplets in total are ejected as shown in FIG. 9C. Controlling Ts/Td to satisfy the above condition prevents ejection of such three ink droplets. This improves the reproducibility of an image to be formed by each inkjet head.

Even in an inkjet head constructed so that each ink droplet ejected from the inkjet head does not split and therefore the reproducibility of an image is good, some designs of the first partial passage may cause deterioration of the efficiency of the energy necessary for ink ejection. For example, the smaller the proper oscillation period Td of ink in the first partial passage relative to the proper oscillation period Tc of ink in the whole of the individual ink passage, the smaller the loss of energy due to the propagation of a pressure wave in the first partial passage. On the other hand, the smaller the proper oscillation period Ts of the integral oscillation of the actuator and the pressure chamber relative to Tc, the more the rigidity of the actuator becomes effective in energy efficiency.

From the above consideration, the inventors of the present invention rearranged the results of Table 6 from a perspective how the ink ejection speed changes in accordance with (Td/Tc)×(Ts/Tc). The below Table 8 shows results of the rearrangement of Table 6 from the perspective. The below Table 7 shows $Td \times Ts/Tc^2$ for each value of L1 of each inkjet head. The numeric values in Table 7 were obtained from Tables 1, 3, and 5.

Table 8 shows ejection speeds of first and second ink droplets for each value of $Td \times Ts/Tc^2$ corresponding to Ts/Td in Table 6. Table 8 also shows the difference in the ejection speed between the first and second ink droplets. In Table 8, there is excluded data of cases wherein three ink droplets in total are ejected.

TABLE 7

| | L1 = 200 μm | 400 μm | 600 μm | 800 μm | 1000 μm |
|---|---|---|---|---|---|
| Head a | 0.0025 | 0.0049 | 0.0066 | 0.0084 | 0.0093 |
| Head b | 0.0029 | 0.0057 | 0.0077 | 0.0097 | 0.0110 |
| Head c | 0.0032 | 0.0063 | 0.0084 | 0.0108 | 0.0122 |
| Head d | 0.0035 | 0.0069 | 0.0092 | 0.0118 | 0.0133 |
| Head e | 0.0038 | 0.0074 | 0.0100 | 0.0128 | 0.0145 |
| Head f | 0.0042 | 0.0083 | 0.0112 | 0.0143 | 0.0162 |

TABLE 8

| | $\frac{Td * Ts}{Tc^2}$ | first droplet | second droplet | Difference in speed |
|---|---|---|---|---|
| Head a | 0.0025 | 8.7 | 5.6 | 3.1 |
| | 0.0049 | 8.5 | 5.7 | 2.8 |
| | 0.0066 | 7.6 | 5.4 | 2.2 |
| | 0.0084 | 7.4 | 5.2 | 2.2 |
| | — | — | — | — |
| Head b | — | — | — | — |
| | 0.0057 | 8.2 | 5.4 | 2.8 |
| | 0.0077 | 7.6 | 5.5 | 2.1 |
| | — | — | — | — |
| | 0.0110 | 7.7 | 5.9 | 1.8 |

TABLE 8-continued

| | $\frac{Td * Ts}{Tc^2}$ | first droplet | second droplet | Difference in speed |
|---|---|---|---|---|
| Head c | — | — | — | — |
| | — | — | — | — |
| | 0.0084 | 7.5 | 5.7 | 1.8 |
| | — | — | — | — |
| | — | — | — | — |
| Head d | — | — | — | — |
| | 0.0068 | 7.8 | 5.7 | 2.1 |
| | — | — | — | — |
| | 0.0118 | 7.5 | 5.3 | 2.2 |
| | 0.0133 | 7.3 | 5.4 | 1.9 |
| Head e | — | — | — | — |
| | 0.0128 | 7.6 | 5.8 | 1.8 |
| | — | — | — | — |
| | 0.0145 | 7.8 | 6.1 | 1.7 |
| | 0.0157 | 6.9 | 5.0 | 1.9 |
| Head f | — | — | — | — |
| | — | — | — | — |
| | 0.0112 | 7.9 | 5.8 | 2.1 |
| | — | — | — | — |
| | 0.0162 | 6.4 | 5.0 | 1.4 |

Figure 12:
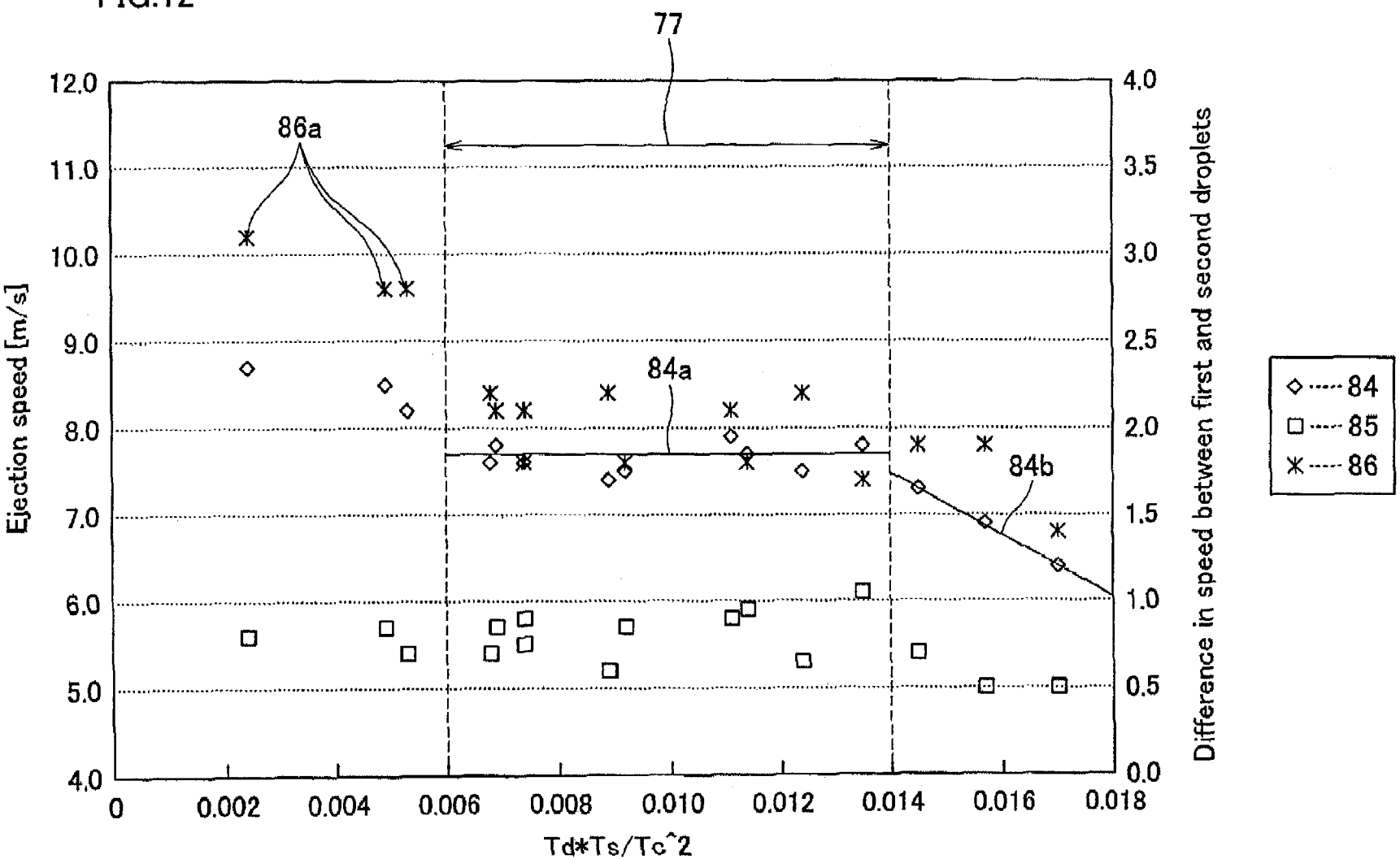
FIG. 12 is another graph showing results of numeric analysis performed by using the model shown in FIGS. 10A to 10C.

FIG. 12 is a graph showing the results of Table 8. In FIG. 12, the axis of abscissas represents $Td \times Ts/Tc^2$ and the axis of ordinate represents the ejection speeds of first and second droplets or the difference in the ejection speed. Points 84, 85, and 86 plotted in FIG. 12 represent the ejection speed of the first droplet, the ejection speed of the second droplet, and the difference in the ejection speed between the first and second droplets, respectively.

In FIG. 12, a segment 84*a* represents a mean value of the ejection speeds represented by the points 84 contained in a range 77. As shown by the segment 84*a* and the points 84, the ejection speed of the first droplet is substantially constant in the range 77. On the other hand, in a range above $Td \times Ts/Tc^2 = 0.014$, which is the upper limit of the range 77, the ejection speed of the first droplet sharply lowers, as shown by a segment 84*b*. *Therefore, in the range of* $Td \times Ts/Tc^2 > 0.014$, the efficiency of the energy consumed for ink ejection is bad relative to the supplied energy.

On the other hand, in a range below $Td \times Ts/Tc^2 = 0.006$, which is the lower limit of the range 77, the difference in the ejection speed between the first and second droplets is considerably wide in comparison with the other ranges. That is, the ejection speed of the first droplet is too high in comparison with the ejection speed of the second droplet. This results in a shift of the timing at which an ink droplet impacts a printing paper. This reduces the quality of an image to be formed on the printing paper.

According to the above analysis, each inkjet head is further preferably constructed such that Ts, Td, and Tc satisfy a condition that $Td \times Ts/Tc^2$ is not less than 0.0060 and not more than 0.014. In the condition, Tc represents the proper oscillation period of ink filling up the whole of the individual ink passage 32. According to the above analysis, this construction improves the efficiency of the energy necessary for ink ejection; and prevents the shift of the timing at which an ink droplet impacts a printing paper, so as to improve the quality of an image to be formed on the printing paper.

In the above-described embodiment, a portion of the first partial passage near the boundary with the pressure chamber is narrower than a longitudinally middle portion of the first partial passage. This structure is apt to cause generation of a local proper oscillation in the first partial passage. Therefore, when the present invention is applied to this structure, a remarkable effect is obtained in comparison with a case wherein the present invention is applied to an inkjet head having a structure originally hard to cause generation of such a proper oscillation.

In the above-described embodiment, a longitudinally middle portion of the second partial passage is narrower than portions of the second partial passage near the boundary with the pressure chamber 10 and near the sub manifold channel 5*a*. This structure is apt to cause generation of a proper oscillation in which one of the positions of the second partial passage is one end to reflect. Therefore, the above-described embodiment has a structure suitable for ink ejection by the fill-before-fire method.

In the above-described embodiment, either of the pressure chamber 10 and the individual electrode 35 has a shape, in a plan view, that is long along one axis and tapered in both directions along the axis from the center of the axis. This makes it possible to densely arrange a large number of pressure chambers and a large number of individual electrodes in respective planes. This realizes an inkjet head high in resolution.

While this invention has been described in conjunction with the specific embodiments outlined above, it is evident that many alternatives, modifications and variations will be apparent to those skilled in the art. Accordingly, the preferred embodiments of the invention as set forth above are intended to be illustrative, not limiting. Various changes may be made without departing from the spirit and scope of the invention as defined in the following claims.

What is claimed is:

1. An inkjet head comprising:

a passage unit comprising a common ink chamber, and an individual ink passage leading from an outlet of the common ink chamber through a pressure chamber to an ink ejection port; and an actuator that can selectively take a first state wherein a volume of the pressure chamber is V1 and a second state wherein the volume of the pressure chamber is V2 larger than V1, the actuator changing from the first state to the second state and then returning to the first state to eject ink from the ejection port, a proper oscillation period Ts of an oscillation generated by integral deformation of the actuator and the pressure chamber when ink is ejected from the ejection port, and a proper oscillation period Td of ink filling up a first partial passage in the individual ink passage leading from an outlet of the pressure chamber to the ejection port, satisfying a condition that Ts/Td is not less than 0.36 and not more than 0.90; or not less than 1.1 and not more than 1.7.

2. The head according to claim 1, wherein Ts and Td satisfy a condition that Ts/Td is not less than 0.36 and not more than 0.48; not less and 0.60 and not more than 0.90; or not less than 1.1 and not more than 1.7.

3. The head according to claim 1, wherein Ts, Td, and a proper oscillation period Tc of ink filling up the whole of the individual ink passage, satisfy a condition that $Ts \times Td/Tc^2$ is not less than 0.0060 and not more than 0.014.

4. The head according to claim 1, wherein the area of a section of the first partial passage, which leads from the outlet of the pressure chamber to the ejection port, perpendicular to a longitudinal axis of the first partial passage in a region of the first partial passage, is larger than either of the area of a boundary between the first partial passage and the pressure chamber and the area of the ejection port.

5. The head according to claim 1, wherein the area of a section of a second partial passage in the individual ink passage, which leads from the outlet of the common ink chamber to the pressure chamber, perpendicular to a longitudinal axis of the second partial passage in a region of the second partial passage, is smaller than either of the area of a boundary between the second partial passage and the pressure chamber and the area of the outlet of the common ink chamber.

6. The head according to claim 1, wherein the actuator comprises an individual electrode opposed to the pressure chamber; a piezoelectric layer having a region opposed to the pressure chamber; and a common electrode cooperating with the individual electrode to sandwich the region of the piezoelectric layer.

7. The head according to claim 6, wherein the actuator takes the first state when the voltage between the individual electrode and the common electrode has a first value not equal to zero, and the actuator takes the second state when the voltage between the individual electrode and the common electrode has a second value smaller than the first value.

8. The head according to claim 6, wherein the individual electrode and the common electrode sandwich only one piezoelectric layer.

9. The head according to claim 6, wherein either of the pressure chamber and the individual electrode has a shape, in a plan view, that is long along one axis and tapered in both directions along the axis from the center of the axis.

* * * * *